US010811784B2

(12) United States Patent
Sikes et al.

(10) Patent No.: US 10,811,784 B2
(45) **Date of Patent: *Oct. 20, 2020**

(54) BROADBAND RF RADIAL WAVEGUIDE FEED WITH INTEGRATED GLASS TRANSITION

(71) Applicant: KYMETA CORPORATION, Redmond, WA (US)

(72) Inventors: Benjamin Sikes, Seattle, WA (US); Mohsen Sazegar, Kirkland, WA (US); Robert Morey, Sammamish, WA (US); Matthew Riley, Marysville, WA (US)

(73) Assignee: KYMETA CORPORATION, Redmond, WA (US)

( * ) Notice: Subject to any disclaimer, the term of this patent is extended or adjusted under 35 U.S.C. 154(b) by 529 days.

This patent is subject to a terminal disclaimer.

(21) Appl. No.: 15/442,320

(22) Filed: Feb. 24, 2017

(65) Prior Publication Data

US 2017/0256865 A1 Sep. 7, 2017

Related U.S. Application Data

(60) Provisional application No. 62/302,042, filed on Mar. 1, 2016.

(51) Int. Cl.
*H01Q 21/00* (2006.01)
*H01Q 1/38* (2006.01)
(Continued)

(52) U.S. Cl.
CPC ..... *H01Q 21/005* (2013.01); *H01Q 1/38* (2013.01); *H01Q 1/48* (2013.01); *H01Q 1/52* (2013.01);
(Continued)

(58) Field of Classification Search
CPC .... H01Q 21/005; H01Q 21/0012; H01Q 3/26; H01Q 1/52; H01Q 1/38; H01Q 13/10; H01Q 9/0407; H01Q 1/48
See application file for complete search history.

(56) References Cited

U.S. PATENT DOCUMENTS 7,009,558 B1 3/2006 Fall et al.
2004/0233117 A1 11/2004 Milroy et al.
(Continued)

FOREIGN PATENT DOCUMENTS

DE 4026432 2/1991
EP 1122813 A2 8/2001
(Continued)

OTHER PUBLICATIONS

PCT Application No. PCT/US2017/019743, International Search Report and the Written Opinion, dated May 31, 2017, 15 pgs.
(Continued)

*Primary Examiner* — Hai V Tran
*Assistant Examiner* — Michael M Bouizza
(74) *Attorney, Agent, or Firm* — Womble Bond Dickinson (US) LLP

(57) ABSTRACT

An antenna and method for using the same are disclosed. In one embodiment, an antenna comprises a radial waveguide; an aperture operable to radiate radio frequency (RF) signals in response to an RF feed wave fed by the radial waveguide; and a radio frequency (RF) choke operable to block RF energy from exiting through a gap between outer portions of the waveguide and the aperture.

28 Claims, 16 Drawing Sheets

(51) Int. Cl.

| | |
|---|---|
| ***H01Q 1/48*** | (2006.01) |
| ***H01Q 13/10*** | (2006.01) |
| ***H01Q 9/04*** | (2006.01) |
| ***H01Q 1/52*** | (2006.01) |
| ***H01Q 3/26*** | (2006.01) |

(52) U.S. Cl.
CPC ..... *H01Q 3/26* (2013.01); *H01Q 9/0407* (2013.01); *H01Q 13/10* (2013.01); *H01Q 21/0012* (2013.01)

(56) References Cited

U.S. PATENT DOCUMENTS

| | | | | |
|---|---|---|---|---|
| 2008/0068263 | A1 | 3/2008 | Tekawy et al. | |
| 2015/0236412 | A1 | 8/2015 | Bily | |
| 2015/0288063 | A1* | 10/2015 | Johnson | H01Q 21/005 342/352 |
| 2015/0380789 | A1* | 12/2015 | Jakoby | H01Q 9/0407 343/905 |
| 2016/0006121 | A1 | 1/2016 | El-Sallabi et al. | |

FOREIGN PATENT DOCUMENTS

| | | | |
|---|---|---|---|
| EP | 1229342 | A2 | 8/2002 |
| EP | 1863114 | | 12/2007 |
| WO | 2013/134585 | A2 | 9/2013 |

OTHER PUBLICATIONS

International Search Report and Written Opinion received for PCT Patent Application No. PCT/US2017/020232, dated Jun. 20, 2017, 13 pages.

International Preliminary Report on Patentability received for PCT Patent Application No. PCT/US2017/020232, dated Sep. 13, 2018, 11 pages.

International Preliminary Report on Patentability received for PCT Patent Application No. PCT/US2017/019743, dated Sep. 13, 2018, 10 pages.

* cited by examiner

Iris L2

Iris L1

Patch and Iris L1

Top View

BROADBAND RF RADIAL WAVEGUIDE FEED WITH INTEGRATED GLASS TRANSITION

PRIORITY

The present patent application claims priority to and incorporates by reference the corresponding provisional patent application Ser. No. 62/302,042, titled, "Broadband RF Radial Waveguide Feed with Integrated Glass Transition," filed on Mar. 1, 2016.

FIELD OF THE INVENTION

Embodiments of the present invention relate to the field of antennas; more particularly, embodiments of the present invention relate to antennas having a radio-frequency (RF) choke to prevent RF energy from an RF feed wave used to excite antenna elements from exiting an antenna.

BACKGROUND OF THE INVENTION

Traditional planar antennas that integrate a radiating aperture and feed structure ensure a physical conductive connection between the two subassemblies to provide a current return path for direct current (DC) control and power conditioning signals as well as RF signals to prevent extraneous radiation from the electrical interface from corrupting the radiation patterns of the antenna. Typical feed structures in these types of antennas tend to feed RF energy into the radiating aperture via a corporate feed arrangement or a combined series/parallel arrangement that provides power distribution as well as aperture tapering in the case of passive phased array antennas. These power distribution networks tend to have many RF power dividers and discontinuities that necessitate the use of stringent design criteria to ensure the cascaded performance of the whole feed meets the requirements of the system. In the case of the edge fed radial waveguide feed, the power distribution is handled by the nature of the dilution of the energy about the antenna radius, but still requires the use of careful design principles to accomplish a robust broadband design.

One instantiation of the radial feed antenna used a relatively narrow band approach for launching and terminating the propagating waves as well as in the discontinuity compensation in the layer transitions. In the launch, a quarter-wavelength open transmission line stub was designed to transition from an axial transverse electromagnetic (TEM) mode to a radial TEM mode. The quarter wavelength open stub launch depends on the resonant length of the center conductor to transition from a guided mode to a quasi-radiative mode as if radiating into free space. The resonance of the launch structure is inherently band limited and difficult to extend beyond 20% bandwidth without adding other tuning mechanisms to compensate for the resonance. The free standing probe also limits the average power handling capacity of the launch to roughly 10 watts or less for a standard SubMiniature version A (SMA) center pin. Any heat accumulated at the launch will be dissipated only through radiation or convection, which will be limited due to the surface area of the probe and the air flow within the waveguide cavity. In addition to the launch, the transition from bottom guide to the top slow wave guide uses one capacitive step to offset inductance caused by the 180 degree e-plane bend. While these approaches are standard for waveguide components, to achieve bandwidths in excess of 30%, it is necessary to use less frequency-dependent methods for the mode transitions and the discontinuity compensation.

In other more broadband radial waveguide structures, the broadband approach has been to use continuous taper transitions that have smooth transitions from one mode to another. An example feed of this feed approach is shown in FIGS. 1A and B. This approach attaches the center pin of the connector to a fluted transition shorted to the top guide wall. While this approach can achieve broad bandwidths, the fabrication can become difficult due to the complex curves that create these smooth transitions. These transitions usually must be fabricated using a lathe to follow the complex curvature. If further compensation is needed for matching purposes, the continuous curvature offers only the ability to quicken or slow the transition rather than to offer additional features for capacitive or inductive tuning. In addition, the layer transitions are typically accomplished using chamfers, which gives the designer only one knob to adjust to achieve broadband matching.

Development of LCD/glass-based radiating apertures based on dielectric substrates without external metallization layers prevents providing an electrical attachment method similar to the conventional methods described above.

In many conventional phased array antennas, the radiating aperture is built from a machined aluminum housing that acts as both the radiating elements as well as a manifold for integrating thermal and climate control channels with structural rigidity and alignment. The advantage of using aluminum for this function is that aluminum is highly conductive at RF and DC and is readily available and well characterized for machining and assembly. Alternatively, some conventional phased arrays utilize printed circuit board (PCB) technology to reduce the amount of "touch labor" involved in antenna assembly while providing design flexibility to the engineer for RF routing and integrated circuit (IC) integration. Both of these manufacturing technologies provide excellent methods with which the assembly of the antenna can be easily grounded to the antenna chassis and RF feed network.

SUMMARY OF THE INVENTION

An antenna and method for using the same are disclosed. In one embodiment, an antenna comprises a radial waveguide; an aperture operable to radiate radio frequency (RF) signals in response to an RF feed wave fed by the radial waveguide; and a radio frequency (RF) choke operable to block RF energy from exiting through a gap between outer portions of the waveguide and the aperture.

BRIEF DESCRIPTION OF THE DRAWINGS

The present invention will be understood more fully from the detailed description given below and from the accompanying drawings of various embodiments of the invention, which, however, should not be taken to limit the invention to the specific embodiments, but are for explanation and understanding only.

DETAILED DESCRIPTION OF THE PRESENT INVENTION

Figure 1A:
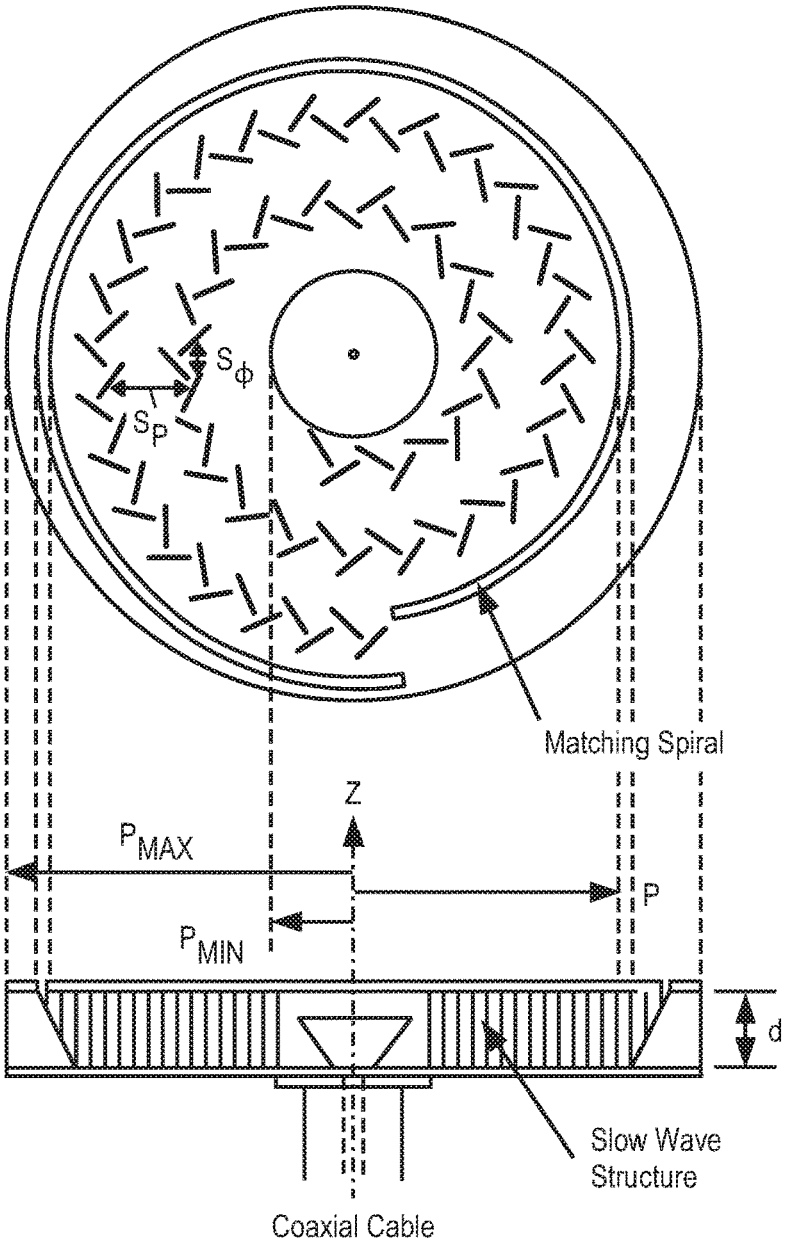
FIGS. 1A and 1B illustrate a single-layered radial line slot antenna and a doubled-layered radial line slot antenna with a radial antenna feed with a fluted launch and chamfered 180° bend.
Figure 1B:
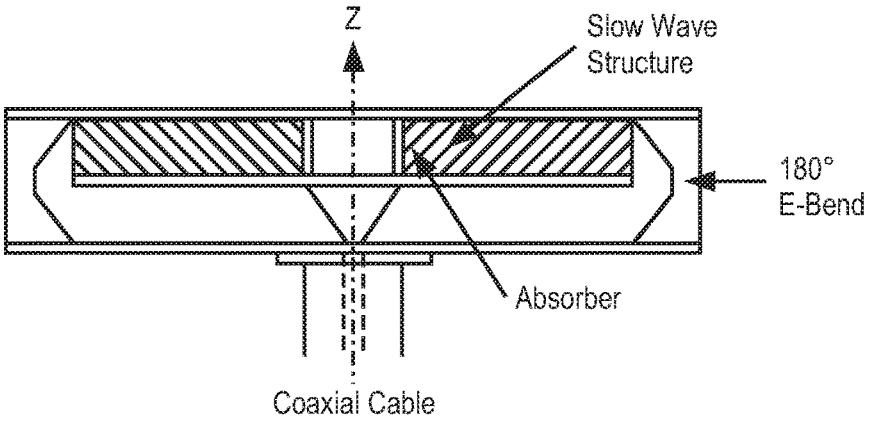

In the following description, numerous details are set forth to provide a more thorough explanation of the present invention. It will be apparent, however, to one skilled in the art, that the present invention may be practiced without these specific details. In other instances, well-known structures and devices are shown in block diagram form, rather than in detail, in order to avoid obscuring the present invention.

Disclosed herein include a radio-frequency (RF) launch and an RF choke assembly that provides the ability to distribute RF power in an edge fed radial waveguide over a broad frequency range. In one embodiment, the RF choke assembly allows a glass-based radiating aperture to be coupled to the radial waveguide without a physical direct current (DC) electrical connection at the waveguide outer extents. In one embodiment, the use of the RF choke allows feeding an RF wave to a circular radiating aperture with a radial, edge fed waveguide over a broad range of RF frequencies as the RF energy is essentially trapped within the antenna at the outer edges of the radiating aperture and the waveguide. In alternative embodiments, the radiating aperture can be substrates other than glass, including, but not limited to, sapphire, fused silicon, quartz, etc. The aperture may comprise a liquid crystal display (LCD).

In one embodiment, the RF choke assembly comprises one or more slots. In one embodiment, the slots comprise milled (machined) slots. The slots may act as quarter wave transformers. In another embodiment, the RF choke assembly comprises an electromagnetic band gap (EBG) choke. The EBG choke may be a printed circuit board (PCB)-based EBG choke.

Also disclosed herein are broadband launch and termination features that may be incorporated into an antenna.

Example Embodiments

In one embodiment, an antenna is disclosed that comprises a radial waveguide; an aperture operable to radiate radio frequency (RF) signals in response to an RF feed wave fed by the radial waveguide; and a radio frequency (RF) choke operable to block RF energy from exiting through a gap between outer portions of the waveguide and the aperture. In one embodiment, there is no physical electrical connection between the waveguide and the aperture. In such a case, the two may be held in place with a clamp mechanism on the outsides of the waveguide and the aperture. Even so, there is no electrically conductive connection between the two. In one embodiment, a slip plane located in proximity to the gap and facilitates potential movement of the waveguide and/or the radiating aperture.

In one embodiment, the waveguide comprises metal and the aperture comprises a glass or liquid crystal display (LCD) substrate, and the coefficient of thermal expansion of the waveguide and the aperture are different. Because they have different coefficients of thermal expansion, during operation of the antenna, heat may be generated that causes them to expand at different rates, which causes their placement with respect to each other to change positions, thereby preventing the waveguide and the radiating aperture from being connected to each other.

In one embodiment, the RF choke comprises one or more slots in the outer portion of the waveguide in the gap with each of the slots being used to block RF energy of a frequency band. In one embodiment, the slots are part of a pair of rings in the outer portion of the waveguide. The rings are outside the active areas of the aperture used for radiating RF energy.

In one embodiment, the RF choke comprises an electromagnetic band gap (EBG) structure. In one embodiment, the EBG structure comprises a substrate with one or more vias. In one embodiment, the substrate comprises a printed circuit board (PCB) with one or more electrically conductive patches and the one or more vias are plated with electrically conductive material. In one embodiment, the PCB is attached to the waveguide with conductive adhesive. Note that in one embodiment no vias are needed because the bandwidth is narrow.

In one embodiment, the aperture has a slotted array of antenna elements, wherein the slotted array comprises: a plurality of slots; and a plurality of patches, wherein each of the patches is co-located over and separated from a slot in the plurality of slots, forming a patch/slot pair, each patch/slot pair being turned off or on based on application of a voltage to the patch in the pair. In one embodiment, the antenna elements are controlled and operable together to form a beam for a frequency band for use in holographic beam steering.

Figure 2:
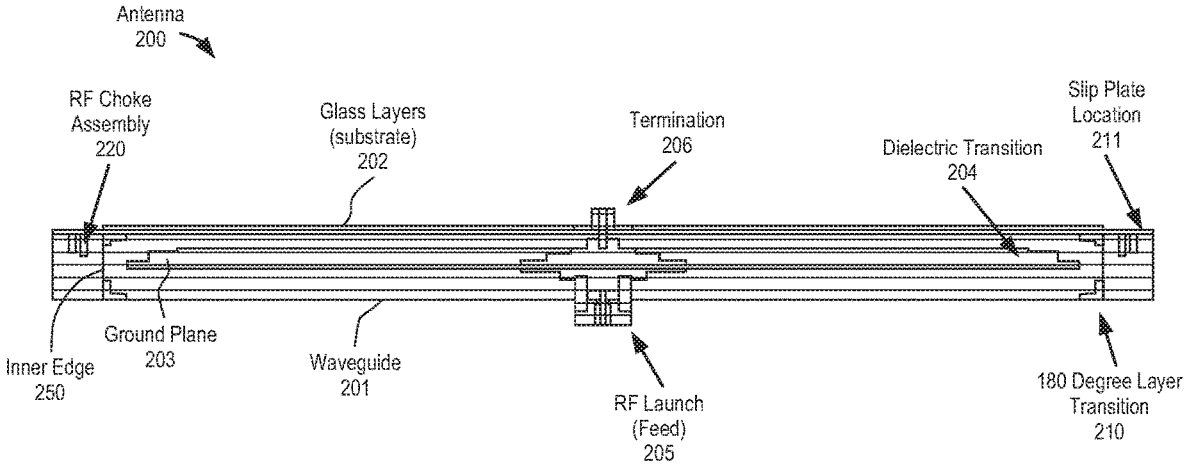
FIGS. 2 and 3 illustrate a side view of one embodiment of an antenna with a stepped RF launch and termination, stepped 180° bend with integrated dielectric transition and RF chokes.
Figure 3:
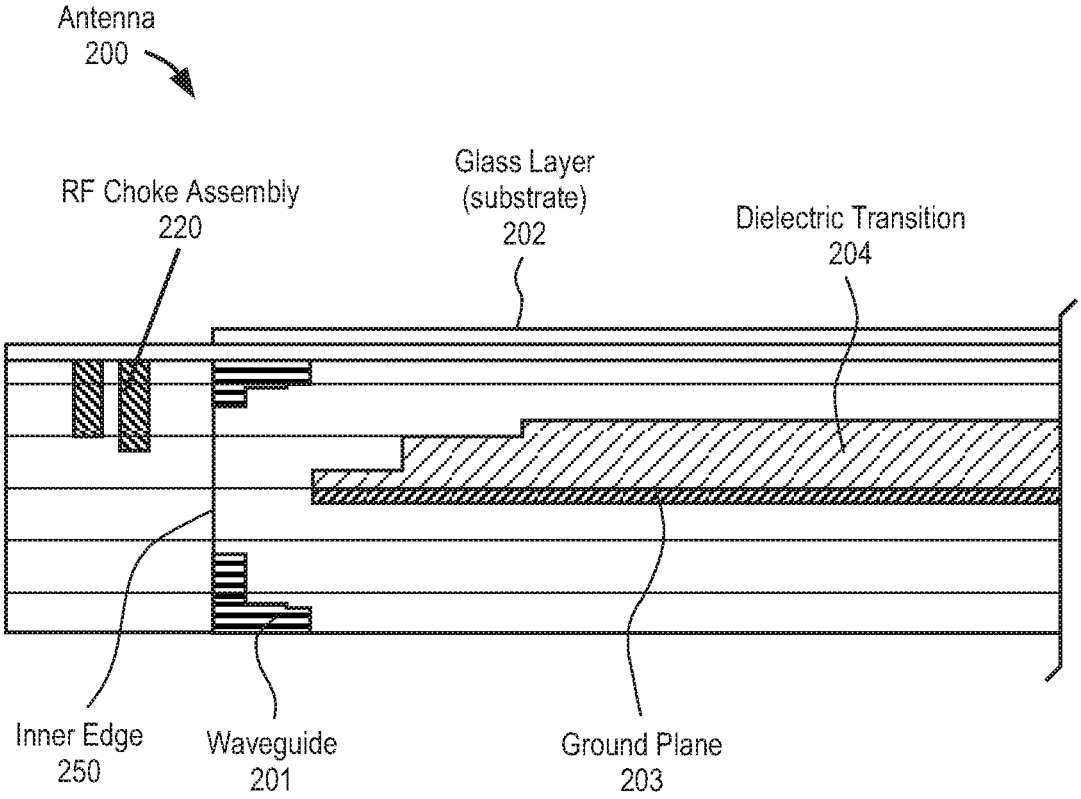

FIGS. 2 and 3 illustrate a side view of one embodiment of an antenna with an RF choke assembly. Referring to FIGS. 2 and 3, antenna 200 includes a radial waveguide 201, an aperture consisting of a substrate or glass layers (panels) 202 with antenna elements (not shown), a ground plane 203, a dielectric (or other layer) transition 204, an RF launch (feed) 205 and a termination 206. Note that while in one embodiment glass layers 202 comprises two glass layers, in other embodiments, the radiating aperture comprises only one glass layer or other substrate with only one layer. Alternatively, the radiating aperture may comprises more than two layers that operate together to radiate RF energy (e.g., a beam).

In one embodiment, the aperture consisting of glass layers (substrate) 202 with antenna elements is operable to radiate radio frequency (RF) signals in response to an RF feed wave fed from RF launch 205 that travels from the central location of RF launch 205 along radial waveguide 201 around ground plane 203 (that acts as a guide plate) and 180° layer transition 210 to glass layers 202 to radiating aperture at the top portion of antenna 200. Using the RF energy, the antenna elements of glass layers 202 radiate RF energy. In one embodiment, the RF energy radiated by glass layers in response to the RF energy from the feed wave is in the form of a beam.

In one embodiment, glass layers (or other substrate) 202 is manufactured using commercial television manufacturing techniques and does not have electrically conductive metal at the most external layer. This lack of conductive media on the external layer of the radiating aperture prevents a physical electrical connection between the subassemblies without further invasive processing of the subassemblies. To provide a connection between glass layers 202 that form the radiating aperture and waveguide 201 that feeds the feed wave to glass layers 202, an equivalent RF connection is made to prevent radiation from the connection seam. This is the purpose of RF choke assembly 202. That is, RF choke assembly RF choke 220 is operable to block RF energy from exiting through a gap between outer portions of waveguide 201 and glass layers 202 that form the radiating aperture. In addition, the difference in the coefficient of thermal expansion of glass layers 202 and feed structure material of waveguide 201 necessitates the need for an intermediate low-friction surface to ensure free planar expansion of the antenna media.

Figure 4A:
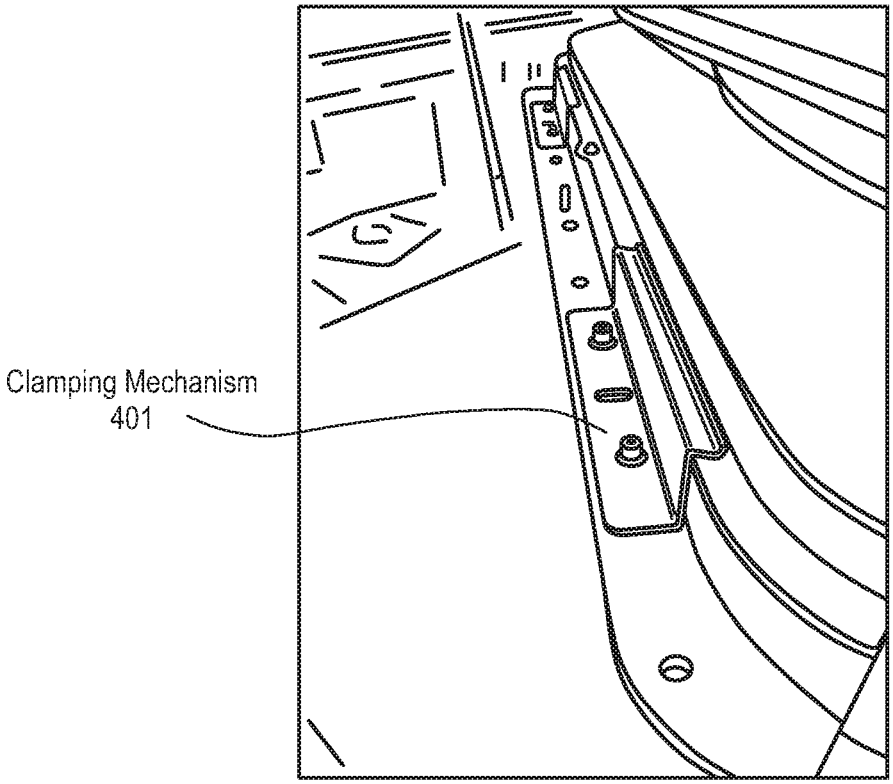
FIG. 4 illustrates one embodiment of a clamping mechanism.
Figure 4B:
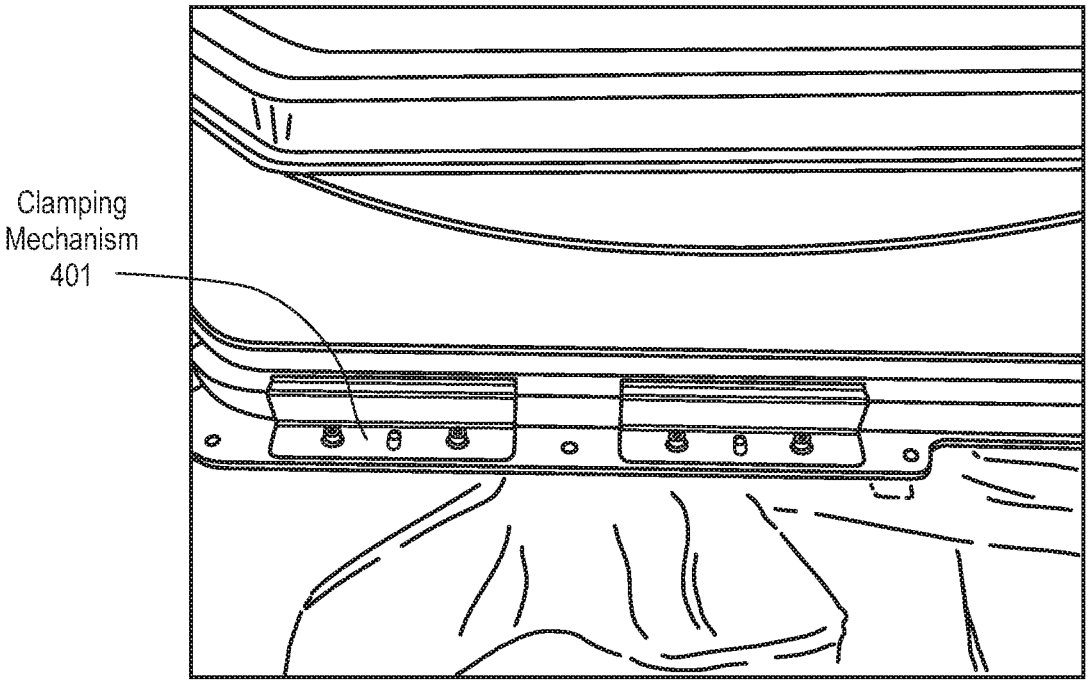

Because the glass layers 202 forming the radiating aperture and waveguide housing are made of different materials with different coefficients of thermal expansion, there is some accommodation made at the extents of the housing of waveguide 201 to allow for physical movement as temperatures vary. To allow for free movement of glass layers 202 and waveguide 201 housing without physically damaging either structure, the glass layers 202 are not permanently bonded to waveguide 201. In one embodiment, glass layers 202 are held mechanically in close intimate contact with waveguide 201 by clamping type features. That is, to hold glass layers 202 generally in position with respect to waveguide 201 in view of their differences in the coefficient of thermal expansion, a clamping mechanism is included. FIG. 4 illustrates an example of such a clamping mechanism. Referring to FIG. 4, clamping machine 401 is coupled to a radome, which is over the glass layers 202, and waveguide 201.

In one embodiment, beneath the clamp features are materials to isolate the clamp from glass layers 202 (i.e., foam, additional thin film or both). An intermediate material with lower friction resistance is added between the aperture and feed to act as a slip plane. The slip plane allows the glass to move laterally. In one embodiment, as discussed above, this may be useful for thermal expansion or thermal mismatch between layers. FIG. 2 illustrates an example of the slip plane location 211.

In one embodiment, the material is thin film in nature and of a plastic material such as, for example, Acrylic, Acetate, or Polycarbonate and is adhered to the underside of the glass or top of the housing of waveguide 201. In addition to cushioning glass layers 202 and providing a slip plane to waveguide 201, the thin sheet material when attached to the glass provides some additional structural support and scratch resistance to the glass. The attachment may be made using an adhesive.

In one embodiment, the radial feed is designed such that each individual component can operate over a large bandwidth, i.e., >50%. The constituent components that make up the feed are: RF launch 205, 180° layer transition 210, termination 206, intermediate ground plane 203 (guide-plate), the dielectric loading of dielectric transition 204, and RF choke assembly 220.

In one embodiment, RF launch 205 has a stepped transition from the input (co)axial mode (direction of propagation is through the conductor) to the radial mode (direction of propagation of the RF wave occurs from the edges of the conductor toward its center). This transition shorts the input pin to a capacitive step that compensates for the probe inductance, then impedance steps out to the full height of radial waveguide 201. The number of steps needed to transition is related to the desired bandwidth of operation and the difference between the initial impedance of the launch and the final impedance of the guide. For example, in one embodiment, for a 10% change in bandwidth, a one step transition is used; for a 20% change in bandwidth, a two-step transition is used; and for a 50% change in bandwidth, a three (or more) step transition is used.

Shorting the pin to ground plane 203 (the top plate of waveguide 201) allows for higher operating power levels by conducting generated heat away from the center pin of RF launch 205 into the housing of waveguide 201 which in one embodiment is metal (e.g., aluminum, copper, brass, gold, etc.). Any risk of dielectric breakdown is reduced by controlling the gaps between the stepped RF launch 205 and the bottom of the housing of waveguide 201 and breaking the sharp edges at the impedance steps.

The top termination transition of RF launch 205 is designed in the same manner with impedance compensation added for the presence of the slow wave dielectric material. By designing the impedance transitions using discrete steps, RF launch 205 is easily manufactured using a three axis computer numeric control (CNC) end mil.

In one embodiment, 180° layer transition 210 is accomplished in a similar manner to the launch and termination design. In one embodiment, a chamfer or single step is used to compensate for the inductance of the 90 degree bends, In another embodiment, multiple steps are used and can individually be tuned to accomplish a broadband match. In one embodiment, the slow wave dielectric transition 204 of the top waveguide is placed at the top 90 degree bend thus adding asymmetry to the full 180 degree transition. This dielectric presence can be compensated for by adding asymmetry to the top and bottom transition steps.

The equivalent RF grounding connection is accomplished by adding RF choke assembly 220 to the feed waveguide/glass interface such that the RF energy within the intended frequency band is reflected from RF choke assembly 220 interface without radiating into free space, and in-turn adding constructively with the propagating feed signal. In one embodiment, these chokes are based on traditional waveguide choke flanges that help ensure robust RF connection for high power applications. Such chokes may also be based on electromagnetic band gap (EBG) structures as described in further detail below. Several RF chokes can be added in series to provide a broadband choke arrangement for use at transmit and receive bands simultaneously.

In one embodiment, RF choke assembly 220 includes waveguide style chokes having one or more slots, or channels, that are integrated into waveguide 201. FIGS. 2 and 3 illustrates two slots. Note that in one embodiment as waveguide 201 is radial, the slots are actually rings that are inside the top of waveguide 201. In one embodiment, the slots are designed to be placed at an odd integer multiple of a quarter wavelength (e.g., ¼, ¾, ⅝, etc.) from the inside of the RF feed junction (i.e., the outer most edge of the inner portion of waveguide 201 through which the feed wave propagates, shown as inner edge 250 in FIG. 2). In one embodiment, the choke channels are also one quarter of a wavelength deep such that the reflected power is in phase at the top of the choke channel. In one embodiment, the total phase length of the choke assembly will in turn be out of phase with the propagating feed signal, which gives the choke assembly (e.g., between the top and bottom of the slot(s)) the equivalent RF performance of an electrical short. This electrical short equivalence maintains the continuity of the feed structure walls without the need for a physical electrical connection.

Note that two choke slots (channels) may be used for each frequency band of the feed wave. For example, two choke slots may be used for one receive frequency band while another two slots are used for a different receive frequency band or a transmit frequency band. For example, transmit and receive frequency bands may be Ka transmit and receive frequency bands, respectively. For another example, the two receive frequency bands may be the Ka and Ku frequency bands, or any band in which communication occurs. The spacing of the slots is the same as above. That is, the slots would be designed to be placed at an odd integer multiple of a quarter wavelength (e.g., ¼, ¾, ⅝, etc.) from the inside of the RF feed junction (e.g., inner edge 250) to create a low impedance short. In one embodiment, the slots of ¼λ deep with a width sized for high impedance (where the λ is that of the frequency to be blocked). While the each of the slots resonate at one frequency (to block energy at that frequency), the choke will likely block a band of frequencies. For example, while the slots resonates at one frequency of the ku band, the choke covers the entire ku band.

Figure 5:
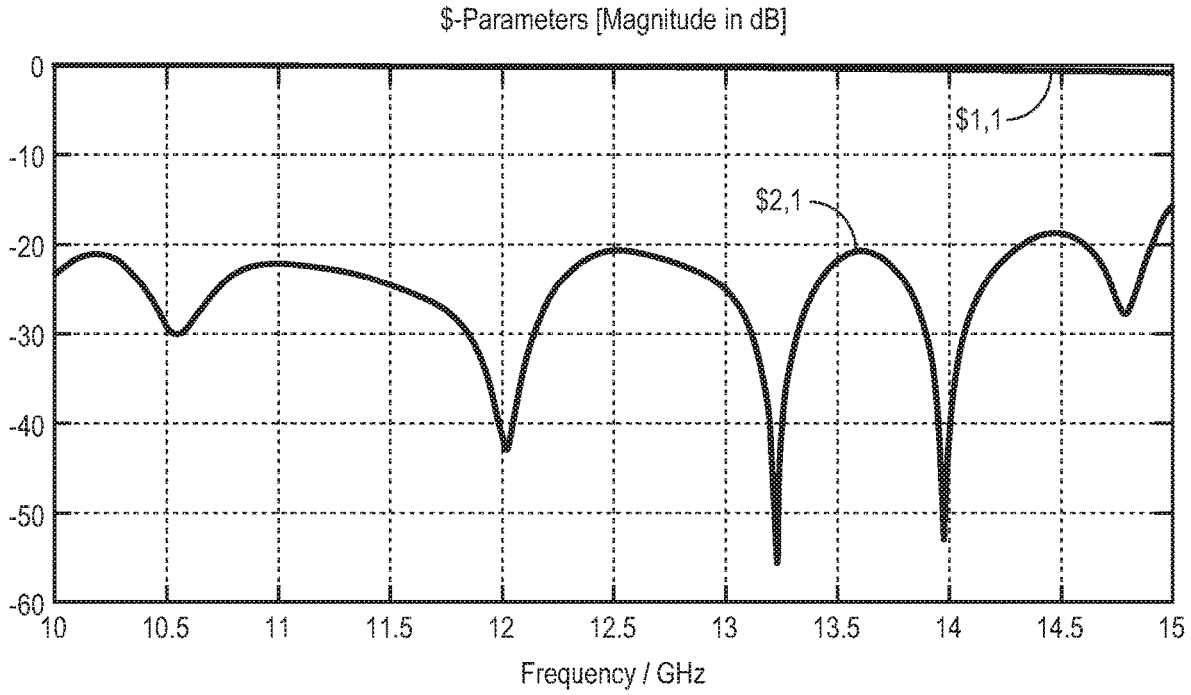
FIG. 5 illustrates RF performance of the antenna feed of the antenna of FIG. 2.

FIG. 5 illustrates RF performance of the feed in FIG. 2. Referring to FIG. 5, the input return loss is better than 10 dB for more than 50% bandwidth.

Figure 6:
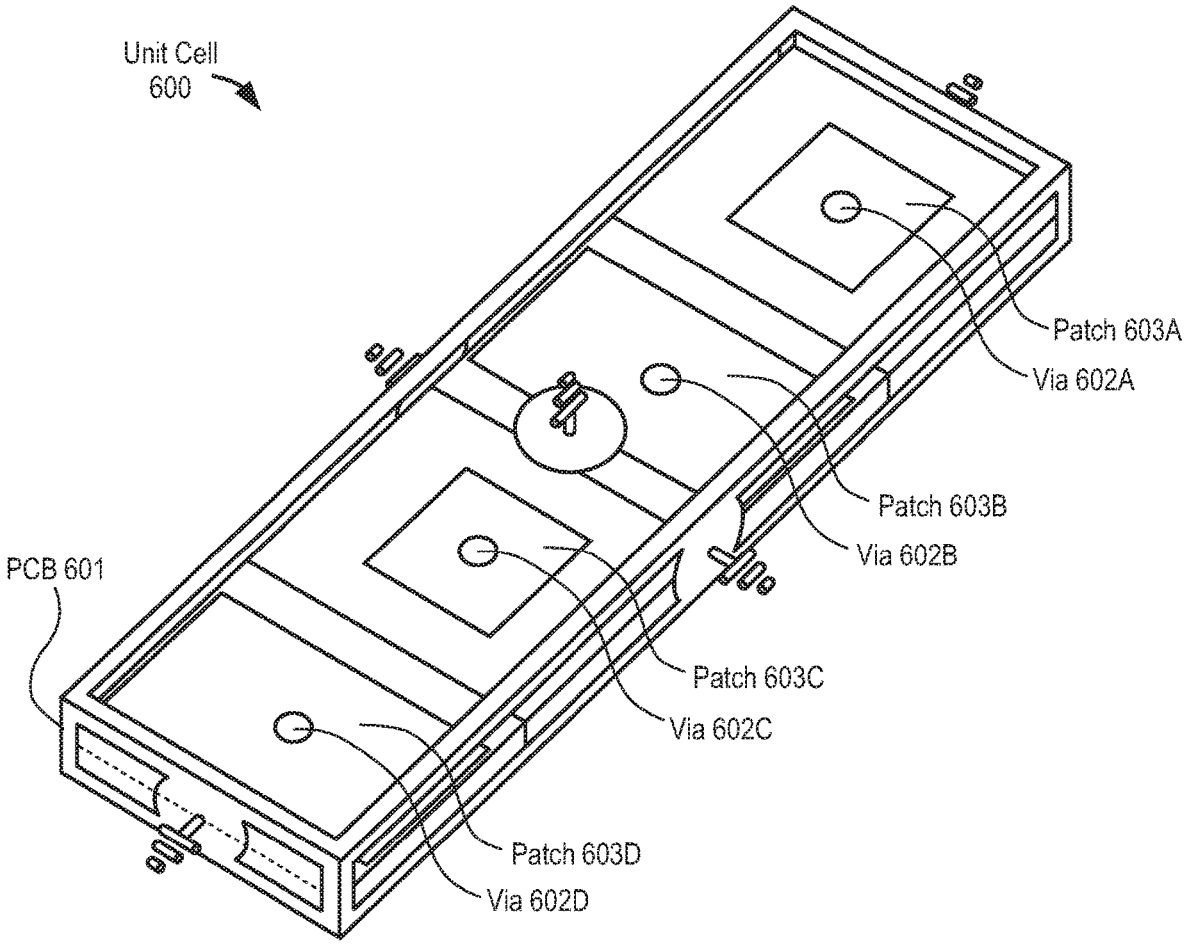
FIG. 6 illustrates one embodiment of an electromagnetic band gap (EBG) structure that is used as an RF choke.
Figure 7:
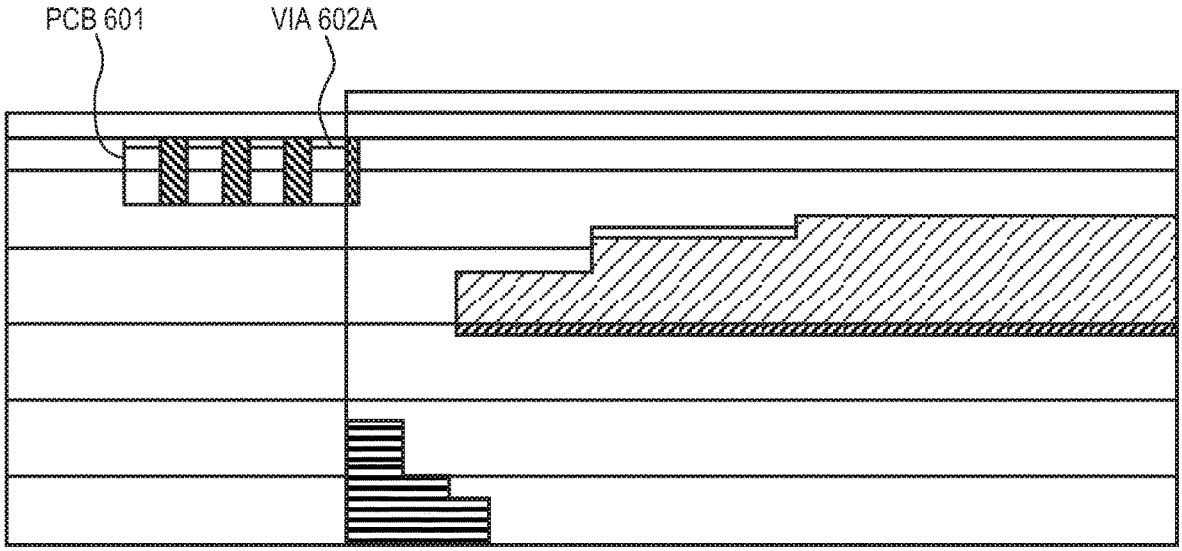
FIG. 7 illustrates a side view of one embodiment of a PCB-based choke having an EBG structure.

In an alternative embodiment, the antenna may include electromagnetic band gap (EBG) materials-based chokes. In one embodiment, electromagnetic band gap (EBG) materials-based chokes are designed as unit cells that prevent propagation over specific frequency bands. The unit cells designed for separate frequency bands can be combined to provide multi-band or broadband operation. FIGS. 6 and 7 illustrate an example of an EBG unit cell choke. Referring to FIG. 6, unit cell 600 comprises a printed circuit board (PCB) 601 with multiple vias, such as vias 602A-602D. Depending on the thickness of the PCB board and the size of the vias, the via spacing may have to be adjusted. Alternatively, Teflon, fiberglass or other materials may be used instead of a PCB.

In one embodiment, vias 602A-602D are not filled and are electroplated with conductive plating, such as, for example, copper, aluminum, etc. Another material, such as, for example, n, may be deposited over the conductive plating for protection. In another alternative embodiment, vias 602A-602D are filled with a material, such as, for example, epoxy.

Each of vias 602A-602D has an electrically conductive patch plated or attached over it, such as patches 603A-603D, respectively. The patch and its via act as an LC resonator that looks like a short. Note that the patch is not required, and is not used in other embodiments.

As shown, the four vias, vias 602A-602D, are used as an RF choke for two frequency bands. In one embodiment, vias 602A and 602C operate as an RF choke for a transmit frequency band, while vias 602B and 602D operate as an RF choke for a receive frequency band. Note that both sets of two vias could be used for receive frequency bands or both for transmit frequency bands.

The highest frequency EBG structure is placed closest to the waveguide joint to ensure the impedance mismatch at the joint doesn't add destructively to the fundamental waveguide mode over the full frequency band. FIG. 7 illustrates a side view of the EBG structure of FIG. 6 attached to a waveguide. Referring to FIG. 7, in one embodiment, PCB 601 is coupled to the waveguide using adhesive. Note that the first via, such as via 602A, is aligned with the side of the waveguide. In one embodiment, via 602A is part of the choke for a transmit frequency band. Therefore, there is a slight overhang of PCB 601 over the inner side wall of the waveguide.

In one embodiment, one or more cushions may be between the EBG unit cell and the glass layers or substrate that operates as the radiating aperture.

Figure 8:
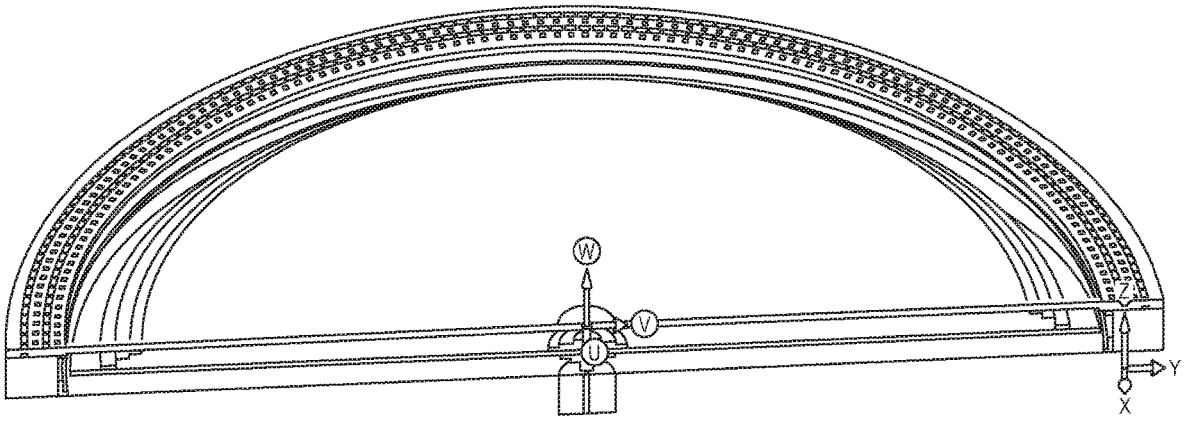
FIG. 8 illustrates one embodiment of an antenna with a cylindrical feed and a EBG choke.

FIG. 8 illustrates a cylindrical feed with an EBG choke, such as the chokes shown in FIG. 7.

In one embodiment, a via-free board is used and simplified assembly (since no conductive glue is needed).

Note that while the above disclosure discusses glass-based or LCD-based radiating apertures based on dielectric substrates without external metallization layers, other radiating apertures based on dielectric substrates with external metallization layers still benefit from this assembly approach.

Examples of Antenna Embodiments

The techniques described above may be used with flat panel antennas. Embodiments of such flat panel antennas are disclosed. The flat panel antennas include one or more arrays of antenna elements on an antenna aperture. In one embodiment, the antenna elements comprise liquid crystal cells. In one embodiment, the flat panel antenna is a cylindrically fed antenna that includes matrix drive circuitry to uniquely address and drive each of the antenna elements that are not placed in rows and columns. Note that the feed need not be circular. In one embodiment, the elements are placed in rings.

In one embodiment, the antenna aperture having the one or more arrays of antenna elements is comprised of multiple segments coupled together. When coupled together, the combination of the segments form closed concentric rings of antenna elements. In one embodiment, the concentric rings are concentric with respect to the antenna feed.

Overview of an Example of Antenna Systems

In one embodiment, the flat panel antenna is part of a metamaterial antenna system. Embodiments of a metamaterial antenna system for communications satellite earth stations are described. In one embodiment, the antenna system is a component or subsystem of a satellite earth station (ES) operating on a mobile platform (e.g., aeronautical, maritime, land, etc.) that operates using either Ka-band frequencies or Ku-band frequencies for civil commercial satellite communications. Note that embodiments of the antenna system also can be used in earth stations that are not on mobile platforms (e.g., fixed or transportable earth stations).

In one embodiment, the antenna system uses surface scattering metamaterial technology to form and steer transmit and receive beams through separate antennas. In one embodiment, the antenna systems are analog systems, in contrast to antenna systems that employ digital signal processing to electrically form and steer beams (such as phased array antennas).

In one embodiment, the antenna system is comprised of three functional subsystems: (1) a wave guiding structure consisting of a cylindrical wave feed architecture; (2) an array of wave scattering metamaterial unit cells that are part of antenna elements; and (3) a control structure to command formation of an adjustable radiation field (beam) from the metamaterial scattering elements using holographic principles.

Examples of Wave Guiding Structures

Figure 9:
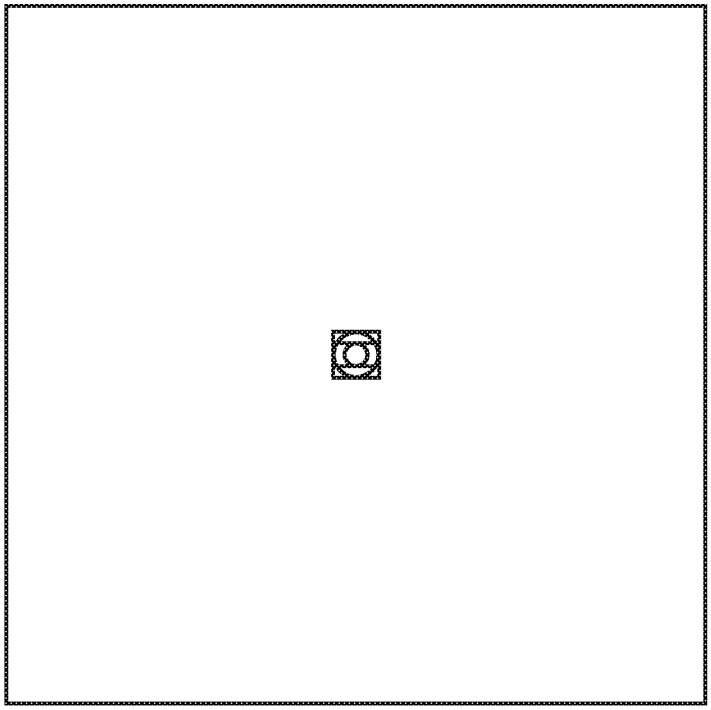
FIG. 9 illustrates a top view of one embodiment of a coaxial feed that is used to provide a cylindrical wave feed.

FIG. 9 illustrates a top view of one embodiment of a coaxial feed that is used to provide a cylindrical wave feed. Referring to FIG. 9, the coaxial feed includes a center conductor and an outer conductor. In one embodiment, the cylindrical wave feed architecture feeds the antenna from a central point with an excitation that spreads outward in a cylindrical manner from the feed point. That is, a cylindrically fed antenna creates an outward travelling concentric feed wave. Even so, the shape of the cylindrical feed antenna around the cylindrical feed can be circular, square or any shape. In another embodiment, a cylindrically fed antenna creates an inward travelling feed wave. In such a case, the feed wave most naturally comes from a circular structure.

Figure 10:
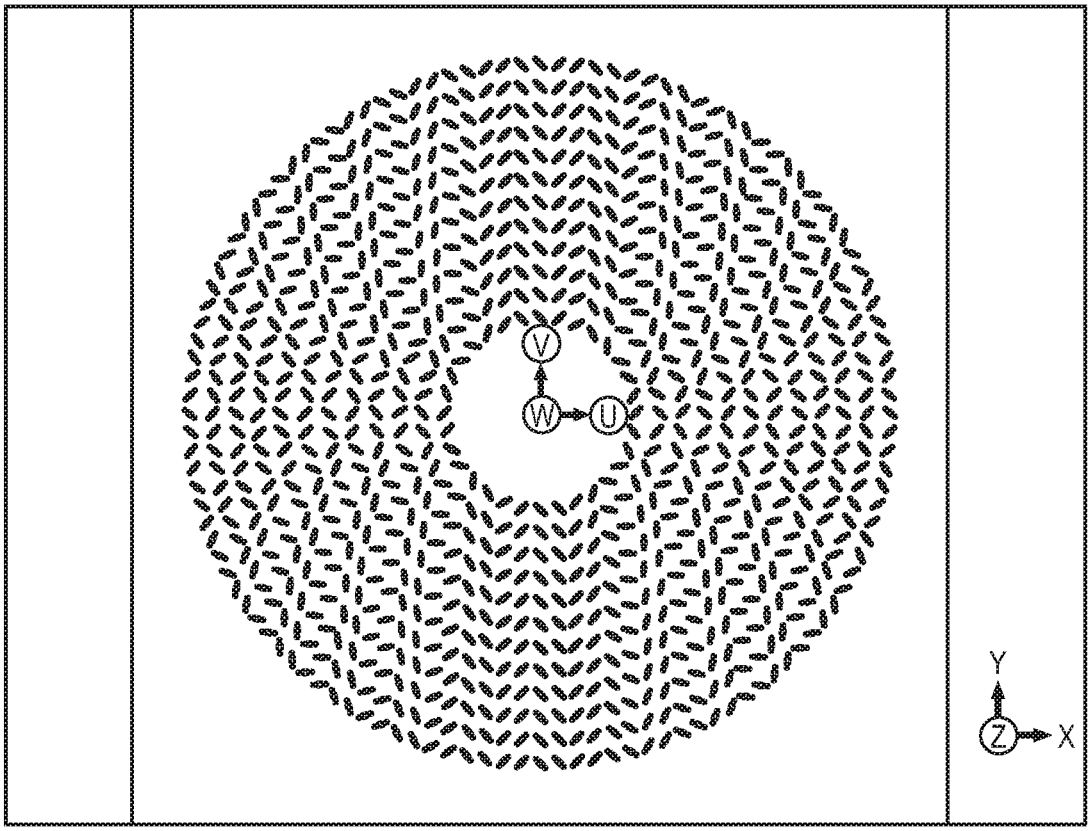
FIG. 10 illustrates an aperture having one or more arrays of antenna elements placed in concentric rings around an input feed of the cylindrically fed antenna.

FIG. 10 illustrates an aperture having one or more arrays of antenna elements placed in concentric rings around an input feed of the cylindrically fed antenna.

Antenna Elements

In one embodiment, the antenna elements comprise a group of patch antennas. This group of patch antennas comprises an array of scattering metamaterial elements. In one embodiment, each scattering element in the antenna system is part of a unit cell that consists of a lower conductor, a dielectric substrate and an upper conductor that embeds a complementary electric inductive-capacitive resonator ("complementary electric LC" or "CELL") that is etched in or deposited onto the upper conductor.

In one embodiment, a liquid crystal (LC) is disposed in the gap around the scattering element. This LC is driven by the direct drive embodiments described above. In one embodiment, liquid crystal is encapsulated in each unit cell and separates the lower conductor associated with a slot from an upper conductor associated with its patch. Liquid crystal has a permittivity that is a function of the orientation of the molecules comprising the liquid crystal, and the orientation of the molecules (and thus the permittivity) can be controlled by adjusting the bias voltage across the liquid crystal. Using this property, in one embodiment, the liquid crystal integrates an on/off switch for the transmission of energy from the guided wave to the CELC. When switched on, the CELC emits an electromagnetic wave like an electrically small dipole antenna. Note that the teachings herein are not limited to having a liquid crystal that operates in a binary fashion with respect to energy transmission.

In one embodiment, the feed geometry of this antenna system allows the antenna elements to be positioned at forty five degree)(45° angles to the vector of the wave in the wave feed. Note that other positions may be used (e.g., at 40° angles). This position of the elements enables control of the free space wave received by or transmitted/radiated from the elements. In one embodiment, the antenna elements are arranged with an inter-element spacing that is less than a free-space wavelength of the operating frequency of the antenna. For example, if there are four scattering elements per wavelength, the elements in the 30 GHz transmit antenna will be approximately 2.5 mm (i.e., ¼th the 10 mm free-space wavelength of 30 GHz).

In one embodiment, the two sets of elements are perpendicular to each other and simultaneously have equal amplitude excitation if controlled to the same tuning state. Rotating them +/−45 degrees relative to the feed wave excitation achieves both desired features at once. Rotating one set 0 degrees and the other 90 degrees would achieve the perpendicular goal, but not the equal amplitude excitation goal. Note that 0 and 90 degrees may be used to achieve isolation when feeding the array of antenna elements in a single structure from two sides.

The amount of radiated power from each unit cell is controlled by applying a voltage to the patch (potential across the LC channel) using a controller. Traces to each patch are used to provide the voltage to the patch antenna. The voltage is used to tune or detune the capacitance and thus the resonance frequency of individual elements to effectuate beam forming. The voltage required is dependent on the liquid crystal mixture being used. The voltage tuning characteristic of liquid crystal mixtures is mainly described by a threshold voltage at which the liquid crystal starts to be affected by the voltage and the saturation voltage, above which an increase of the voltage does not cause major tuning in liquid crystal. These two characteristic parameters can change for different liquid crystal mixtures.

In one embodiment, as discussed above, a matrix drive is used to apply voltage to the patches in order to drive each cell separately from all the other cells without having a separate connection for each cell (direct drive). Because of the high density of elements, the matrix drive is an efficient way to address each cell individually.

In one embodiment, the control structure for the antenna system has 2 main components: the antenna array controller, which includes drive electronics, for the antenna system, is below the wave scattering structure, while the matrix drive switching array is interspersed throughout the radiating RF array in such a way as to not interfere with the radiation. In one embodiment, the drive electronics for the antenna system comprise commercial off-the shelf LCD controls used in commercial television appliances that adjust the bias voltage for each scattering element by adjusting the amplitude or duty cycle of an AC bias signal to that element.

In one embodiment, the antenna array controller also contains a microprocessor executing the software. The control structure may also incorporate sensors (e.g., a GPS receiver, a three axis compass, a 3-axis accelerometer, 3-axis gyro, 3-axis magnetometer, etc.) to provide location and orientation information to the processor. The location and orientation information may be provided to the processor by other systems in the earth station and/or may not be part of the antenna system.

More specifically, the antenna array controller controls which elements are turned off and those elements turned on and at which phase and amplitude level at the frequency of operation. The elements are selectively detuned for frequency operation by voltage application.

For transmission, a controller supplies an array of voltage signals to the RF patches to create a modulation, or control pattern. The control pattern causes the elements to be turned to different states. In one embodiment, multistate control is used in which various elements are turned on and off to varying levels, further approximating a sinusoidal control pattern, as opposed to a square wave (i.e., a sinusoid gray shade modulation pattern). In one embodiment, some elements radiate more strongly than others, rather than some elements radiate and some do not. Variable radiation is achieved by applying specific voltage levels, which adjusts the liquid crystal permittivity to varying amounts, thereby detuning elements variably and causing some elements to radiate more than others.

The generation of a focused beam by the metamaterial array of elements can be explained by the phenomenon of constructive and destructive interference. Individual electromagnetic waves sum up (constructive interference) if they have the same phase when they meet in free space and waves cancel each other (destructive interference) if they are in opposite phase when they meet in free space. If the slots in a slotted antenna are positioned so that each successive slot is positioned at a different distance from the excitation point of the guided wave, the scattered wave from that element will have a different phase than the scattered wave of the previous slot. If the slots are spaced one quarter of a guided wavelength apart, each slot will scatter a wave with a one fourth phase delay from the previous slot.

Using the array, the number of patterns of constructive and destructive interference that can be produced can be increased so that beams can be pointed theoretically in any direction plus or minus ninety degrees (90°)from the bore sight of the antenna array, using the principles of holography. Thus, by controlling which metamaterial unit cells are turned on or off (i.e., by changing the pattern of which cells are turned on and which cells are turned off), a different pattern of constructive and destructive interference can be produced, and the antenna can change the direction of the main beam. The time required to turn the unit cells on and off dictates the speed at which the beam can be switched from one location to another location.

In one embodiment, the antenna system produces one steerable beam for the uplink antenna and one steerable beam for the downlink antenna. In one embodiment, the antenna system uses metamaterial technology to receive beams and to decode signals from the satellite and to form transmit beams that are directed toward the satellite. In one embodiment, the antenna systems are analog systems, in contrast to antenna systems that employ digital signal processing to electrically form and steer beams (such as phased array antennas). In one embodiment, the antenna system is considered a "surface" antenna that is planar and relatively low profile, especially when compared to conventional satellite dish receivers.

Figure 11:
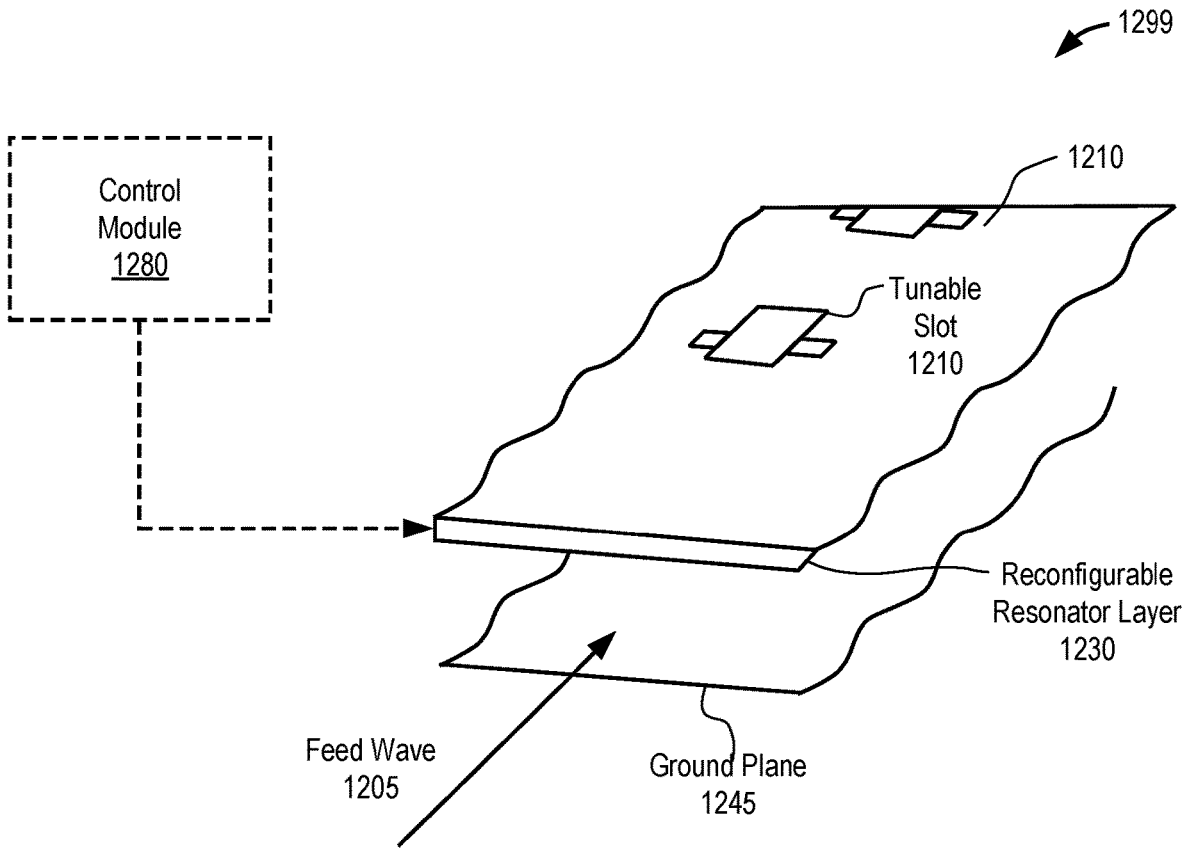
FIG. 11 illustrates a perspective view of one row of antenna elements that includes a ground plane and a reconfigurable resonator layer.

FIG. 11 illustrates a perspective view of one row of antenna elements that includes a ground plane and a reconfigurable resonator layer. Reconfigurable resonator layer 1230 includes an array of tunable slots 1210. The array of tunable slots 1210 can be configured to point the antenna in a desired direction. Each of the tunable slots can be tuned/adjusted by varying a voltage across the liquid crystal.

Control module 1280 is coupled to reconfigurable resonator layer 1230 to modulate the array of tunable slots 1210 by varying the voltage across the liquid crystal in FIG. 11. Control module 1280 may include a Field Programmable Gate Array ("FPGA"), a microprocessor, a controller, System-on-a-Chip (SoC), or other processing logic. In one embodiment, control module 1280 includes logic circuitry (e.g., multiplexer) to drive the array of tunable slots 1210. In one embodiment, control module 1280 receives data that includes specifications for a holographic diffraction pattern to be driven onto the array of tunable slots 1210. The holographic diffraction patterns may be generated in response to a spatial relationship between the antenna and a satellite so that the holographic diffraction pattern steers the downlink beams (and uplink beam if the antenna system performs transmit) in the appropriate direction for communication. Although not drawn in each figure, a control module similar to control module 1280 may drive each array of tunable slots described in the figures of the disclosure.

Radio Frequency ("RF") holography is also possible using analogous techniques where a desired RF beam can be generated when an RF reference beam encounters an RF holographic diffraction pattern. In the case of satellite communications, the reference beam is in the form of a feed wave, such as feed wave 1205 (approximately 20 GHz in some embodiments). To transform a feed wave into a radiated beam (either for transmitting or receiving purposes), an interference pattern is calculated between the desired RF beam (the object beam) and the feed wave (the reference beam). The interference pattern is driven onto the array of tunable slots 1210 as a diffraction pattern so that the feed wave is "steered" into the desired RF beam (having the desired shape and direction). In other words, the feed wave encountering the holographic diffraction pattern "reconstructs" the object beam, which is formed according to design requirements of the communication system. The holographic diffraction pattern contains the excitation of each element and is calculated by $w_{hologram}=w_{in}w_{out}$, with $w_{in}$ as the wave equation in the waveguide and $w_{out}$ the wave equation on the outgoing wave.

Figure 12:
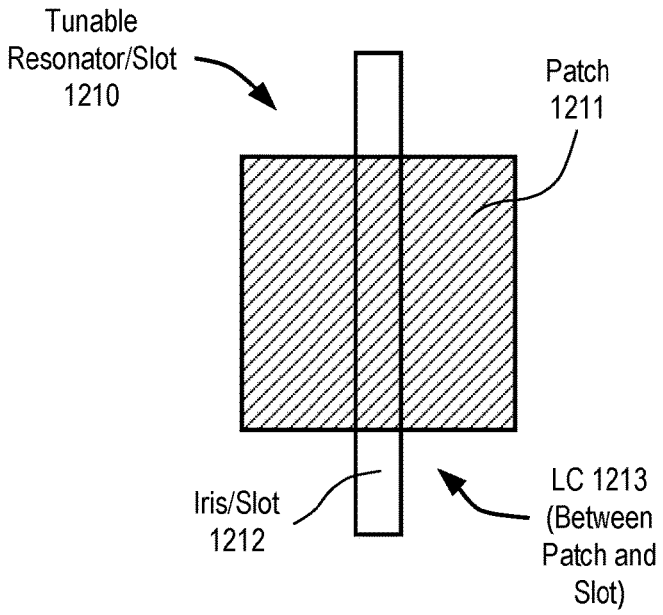
FIG. 12 illustrates one embodiment of a tunable resonator/slot.

FIG. 12 illustrates one embodiment of a tunable resonator/slot 1210. Tunable slot 1210 includes an iris/slot 1212, a radiating patch 1211, and liquid crystal 1213 disposed between iris 1212 and patch 1211. In one embodiment, radiating patch 1211 is co-located with iris 1212.

Figure 13:
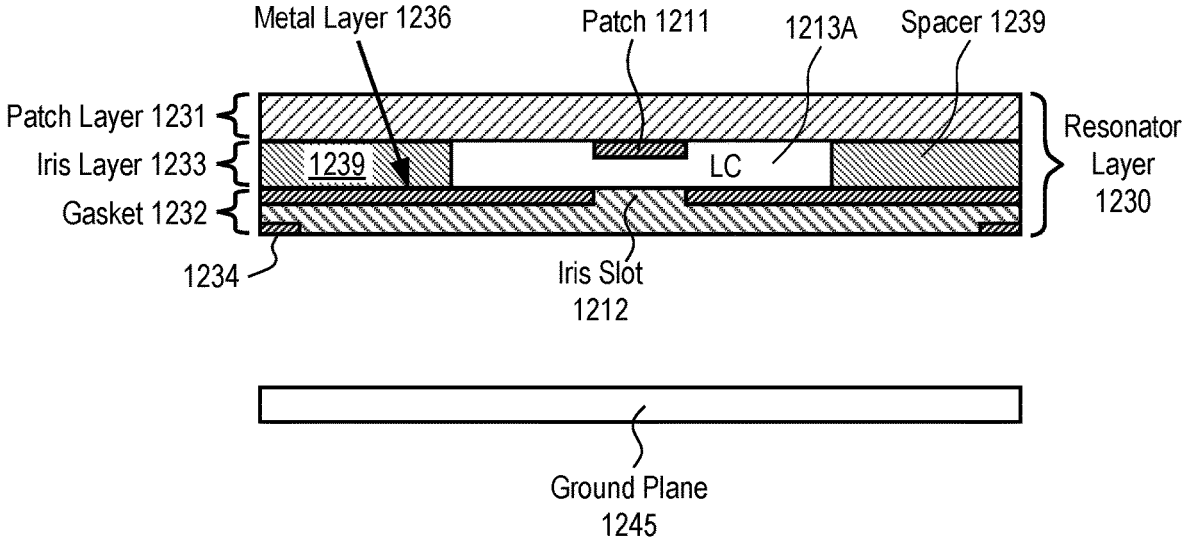
FIG. 13 illustrates a cross section view of one embodiment of a physical antenna aperture.

FIG. 13 illustrates a cross section view of one embodiment of a physical antenna aperture. The antenna aperture includes ground plane 1245, and a metal layer 1236 within iris layer 1233, which is included in reconfigurable resonator layer 1230. In one embodiment, the antenna aperture of FIG. 13 includes a plurality of tunable resonator/slots 1210 of FIG. 12. Iris/slot 1212 is defined by openings in metal layer 1236. A feed wave, such as feed wave 1205 of FIG. 11, may have a microwave frequency compatible with satellite communication channels. The feed wave propagates between ground plane 1245 and resonator layer 1230.

Reconfigurable resonator layer 1230 also includes gasket layer 1232 and patch layer 1231. Gasket layer 1232 is disposed below patch layer 1231 and iris layer 1233. Note that in one embodiment, a spacer could replace gasket layer 1232. In one embodiment, iris layer 1233 is a printed circuit board ("PCB") that includes a copper layer as metal layer 1236. In one embodiment, iris layer 1233 is glass. Iris layer 1233 may be other types of substrates.

Openings may be etched in the copper layer to form slots 1212. In one embodiment, iris layer 1233 is conductively coupled by a conductive bonding layer to another structure (e.g., a waveguide) in FIG. 13. Note that in an embodiment the iris layer is not conductively coupled by a conductive bonding layer and is instead interfaced with a non-conducting bonding layer.

Patch layer 1231 may also be a PCB that includes metal as radiating patches 1211. In one embodiment, gasket layer 1232 includes spacers 1239 that provide a mechanical standoff to define the dimension between metal layer 1236 and patch 1211. In one embodiment, the spacers are 75 microns, but other sizes may be used (e.g., 3-200 mm). As mentioned above, in one embodiment, the antenna aperture of FIG. 13 includes multiple tunable resonator/slots, such as tunable resonator/slot 1210 includes patch 1211, liquid crystal 1213, and iris 1212 of FIG. 12. The chamber for liquid crystal 1213 is defined by spacers 1239, iris layer 1233 and metal layer 1236. When the chamber is filled with liquid crystal, patch layer 1231 can be laminated onto spacers 1239 to seal liquid crystal within resonator layer 1230.

A voltage between patch layer 1231 and iris layer 1233 can be modulated to tune the liquid crystal in the gap between the patch and the slots (e.g., tunable resonator/slot 1210). Adjusting the voltage across liquid crystal 1213 varies the capacitance of a slot (e.g., tunable resonator/slot 1210). Accordingly, the reactance of a slot (e.g., tunable resonator/slot 1210) can be varied by changing the capacitance. Resonant frequency of slot 1210 also changes according to the equation $f=1/2\pi\sqrt{LC}$ where f is the resonant frequency of slot 1210 and L and C are the inductance and capacitance of slot 1210, respectively. The resonant frequency of slot 1210 affects the energy radiated from feed wave 1205 propagating through the waveguide. As an example, if feed wave 1205 is 20 GHz, the resonant frequency of a slot 1210 may be adjusted (by varying the capacitance) to 17 GHz so that the slot 1210 couples substantially no energy from feed wave 1205. Or, the resonant frequency of a slot 1210 may be adjusted to 20 GHz so that the slot 1210 couples energy from feed wave 1205 and radiates that energy into free space. Although the examples given are binary (fully radiating or not radiating at all), full gray scale control of the reactance, and therefore the resonant frequency of slot 1210 is possible with voltage variance over a multi-valued range. Hence, the energy radiated from each slot 1210 can be finely controlled so that detailed holographic diffraction patterns can be formed by the array of tunable slots.

In one embodiment, tunable slots in a row are spaced from each other by $\lambda/5$. Other spacings may be used. In one embodiment, each tunable slot in a row is spaced from the closest tunable slot in an adjacent row by $\lambda/2$, and, thus, commonly oriented tunable slots in different rows are spaced by $\lambda/4$, though other spacings are possible (e.g., $\lambda/5$, $\lambda/6.3$). In another embodiment, each tunable slot in a row is spaced from the closest tunable slot in an adjacent row by $\lambda/3$.

Embodiments use reconfigurable metamaterial technology, such as described in U.S. patent application Ser. No. 14/550,178, entitled "Dynamic Polarization and Coupling Control from a Steerable Cylindrically Fed Holographic Antenna", filed Nov. 21, 2014 and U.S. patent application Ser. No. 14/610,502, entitled "Ridged Waveguide Feed Structures for Reconfigurable Antenna", filed Jan. 30, 2015.

FIGS. 14A-D illustrate one embodiment of the different layers for creating the slotted array. The antenna array includes antenna elements that are positioned in rings, such as the example rings shown in FIG. 10. Note that in this example the antenna array has two different types of antenna elements that are used for two different types of frequency bands.

Figure 14A:
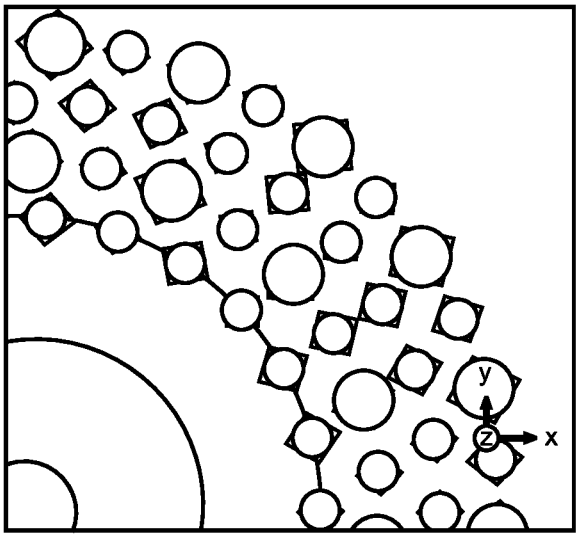
FIGS. 14A-D illustrate one embodiment of the different layers for creating the slotted array.
Figure 14B:
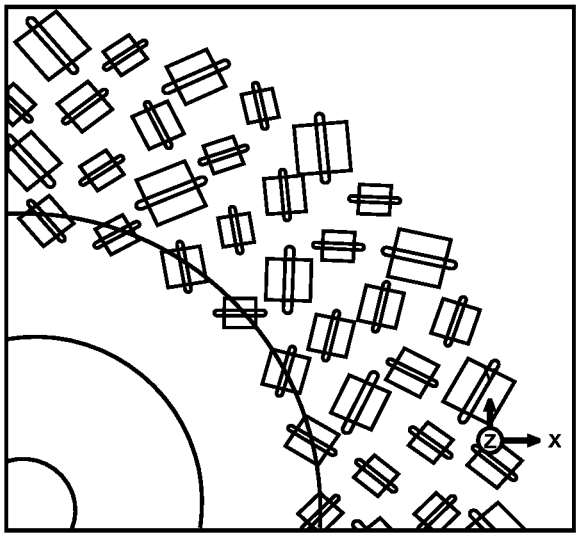
Figure 14C:
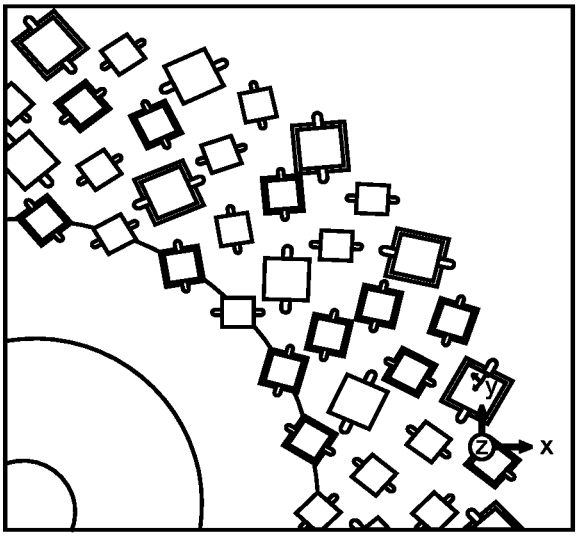
Figure 14D:
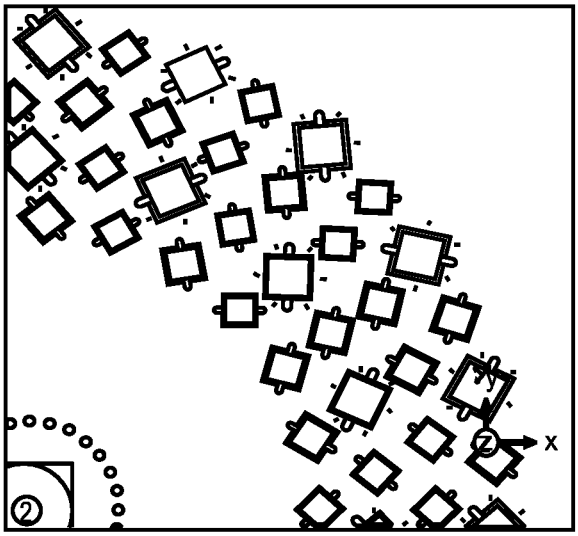

FIG. 14A illustrates a portion of the first iris board layer with locations corresponding to the slots. Referring to FIG. 14A, the circles are open areas/slots in the metallization in the bottom side of the iris substrate, and are for controlling the coupling of elements to the feed (the feed wave). Note that this layer is an optional layer and is not used in all designs. FIG. 14B illustrates a portion of the second iris board layer containing slots. FIG. 14C illustrates patches over a portion of the second iris board layer. FIG. 14D illustrates a top view of a portion of the slotted array.

Figure 15:
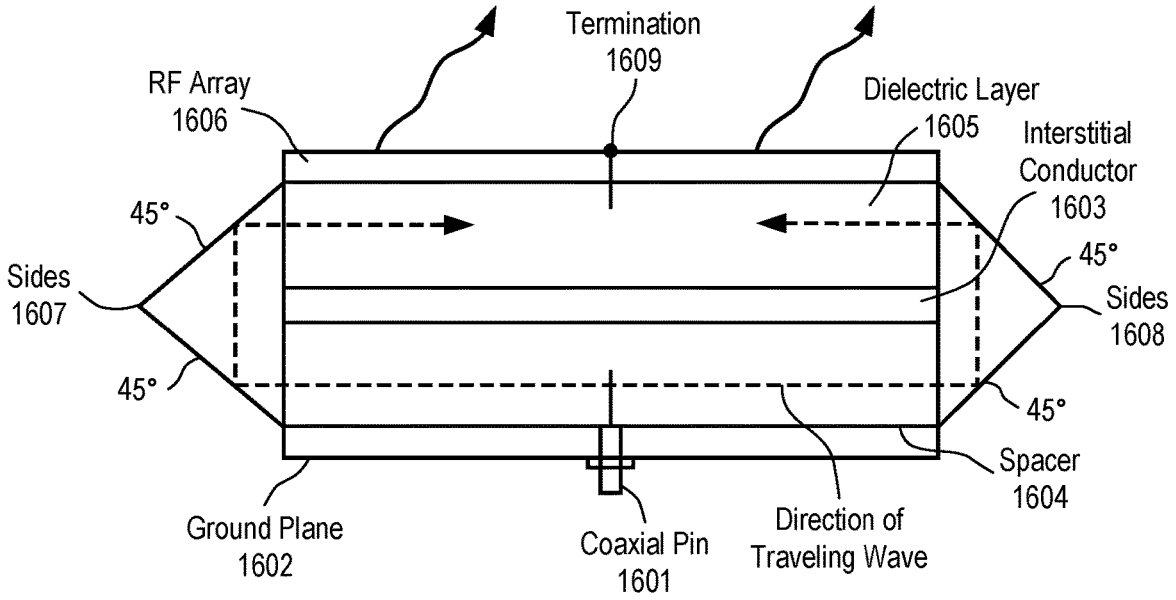
FIG. 15 illustrates a side view of one embodiment of a cylindrically fed antenna structure.

FIG. 15 illustrates a side view of one embodiment of a cylindrically fed antenna structure. The antenna produces an inwardly travelling wave using a double layer feed structure (i.e., two layers of a feed structure). In one embodiment, the antenna includes a circular outer shape, though this is not required. That is, non-circular inward travelling structures can be used. In one embodiment, the antenna structure in FIG. 15 includes the coaxial feed of FIG. 9.

Referring to FIG. 15, a coaxial pin 1601 is used to excite the field on the lower level of the antenna. In one embodiment, coaxial pin 1601 is a 50Ω coax pin that is readily available. Coaxial pin 1601 is coupled (e.g., bolted) to the bottom of the antenna structure, which is conducting ground plane 1602.

Separate from conducting ground plane 1602 is interstitial conductor 1603, which is an internal conductor. In one embodiment, conducting ground plane 1602 and interstitial conductor 1603 are parallel to each other. In one embodiment, the distance between ground plane 1602 and interstitial conductor 1603 is 0.1-0.15". In another embodiment, this distance may be $\lambda/2$, where $\lambda$ is the wavelength of the travelling wave at the frequency of operation.

Ground plane 1602 is separated from interstitial conductor 1603 via a spacer 1604. In one embodiment, spacer 1604 is a foam or air-like spacer. In one embodiment, spacer 1604 comprises a plastic spacer.

On top of interstitial conductor 1603 is dielectric layer 1605. In one embodiment, dielectric layer 1605 is plastic. The purpose of dielectric layer 1605 is to slow the travelling wave relative to free space velocity. In one embodiment, dielectric layer 1605 slows the travelling wave by 30% relative to free space. In one embodiment, the range of indices of refraction that are suitable for beam forming are 1.2-1.8, where free space has by definition an index of refraction equal to 1. Other dielectric spacer materials, such as, for example, plastic, may be used to achieve this effect. Note that materials other than plastic may be used as long as they achieve the desired wave slowing effect. Alternatively, a material with distributed structures may be used as dielectric 1605, such as periodic sub-wavelength metallic structures that can be machined or lithographically defined, for example.

An RF-array 1606 is on top of dielectric 1605. In one embodiment, the distance between interstitial conductor 1603 and RF-array 606 is 0.1-0.15". In another embodiment, this distance may be $\lambda_{eff}/2$, where $\lambda_{eff}$ is the effective wavelength in the medium at the design frequency.

The antenna includes sides 1607 and 1608. Sides 1607 and 1608 are angled to cause a travelling wave feed from coax pin 1601 to be propagated from the area below interstitial conductor 1603 (the spacer layer) to the area above interstitial conductor 1603 (the dielectric layer) via reflection. In one embodiment, the angle of sides 1607 and 1608 are at 45° angles. In an alternative embodiment, sides 1607 and 1608 could be replaced with a continuous radius to achieve the reflection. While FIG. 15 shows angled sides that have angle of 45 degrees, other angles that accomplish signal transmission from lower level feed to upper level feed may be used. That is, given that the effective wavelength in the lower feed will generally be different than in the upper feed, some deviation from the ideal 45° angles could be used to aid transmission from the lower to the upper feed level. For example, in another embodiment, the 45° angles are replaced with a single step. The steps on one end of the antenna go around the dielectric layer, interstitial the conductor, and the spacer layer. The same two steps are at the other ends of these layers.

In operation, when a feed wave is fed in from coaxial pin 1601, the wave travels outward concentrically oriented from coaxial pin 1601 in the area between ground plane 1602 and interstitial conductor 1603. The concentrically outgoing waves are reflected by sides 1607 and 1608 and travel inwardly in the area between interstitial conductor 1603 and RF array 1606. The reflection from the edge of the circular perimeter causes the wave to remain in phase (i.e., it is an in-phase reflection). The travelling wave is slowed by dielectric layer 1605. At this point, the travelling wave starts interacting and exciting with elements in RF array 1606 to obtain the desired scattering.

To terminate the travelling wave, a termination 1609 is included in the antenna at the geometric center of the antenna. In one embodiment, termination 1609 comprises a pin termination (e.g., a 50Ω pin). In another embodiment, termination 1609 comprises an RF absorber that terminates unused energy to prevent reflections of that unused energy back through the feed structure of the antenna. These could be used at the top of RF array 1606.

Figure 16:
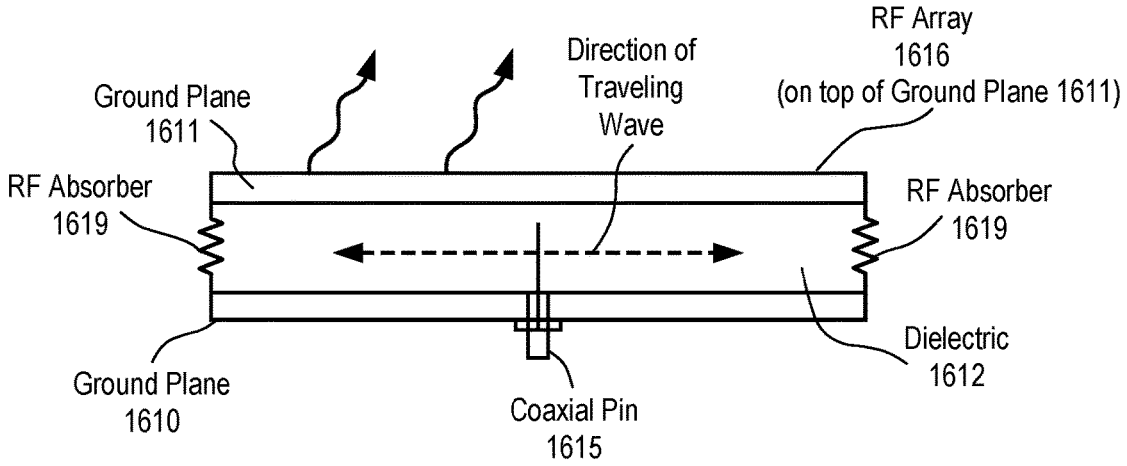
FIG. 16 illustrates another embodiment of the antenna system with an outgoing wave.

FIG. 16 illustrates another embodiment of the antenna system with an outgoing wave. Referring to FIG. 16, two ground planes 1610 and 1611 are substantially parallel to each other with a dielectric layer 1612 (e.g., a plastic layer, etc.) in between ground planes. RF absorbers 1619 (e.g., resistors) couple the two ground planes 1610 and 1611 together. A coaxial pin 1615 (e.g., 50Ω) feeds the antenna. An RF array 1616 is on top of dielectric layer 1612 and ground plane 1611.

In operation, a feed wave is fed through coaxial pin 1615 and travels concentrically outward and interacts with the elements of RF array 1616.

The cylindrical feed in both the antennas of FIGS. 15 and 16 improves the service angle of the antenna. Instead of a service angle of plus or minus forty five degrees azimuth (±45° Az) and plus or minus twenty five degrees elevation (±25° El), in one embodiment, the antenna system has a service angle of seventy five degrees (75°) from the bore sight in all directions. As with any beam forming antenna comprised of many individual radiators, the overall antenna gain is dependent on the gain of the constituent elements, which themselves are angle-dependent. When using common radiating elements, the overall antenna gain typically decreases as the beam is pointed further off bore sight. At 75 degrees off bore sight, significant gain degradation of about 6 dB is expected.

Embodiments of the antenna having a cylindrical feed solve one or more problems. These include dramatically simplifying the feed structure compared to antennas fed with a corporate divider network and therefore reducing total required antenna and antenna feed volume; decreasing sensitivity to manufacturing and control errors by maintaining high beam performance with coarser controls (extending all the way to simple binary control); giving a more advantageous side lobe pattern compared to rectilinear feeds because the cylindrically oriented feed waves result in spatially diverse side lobes in the far field; and allowing polarization to be dynamic, including allowing left-hand circular, right-hand circular, and linear polarizations, while not requiring a polarizer.

Array of Wave Scattering Elements

RF array 1606 of FIG. 15 and RF array 1616 of FIG. 16 include a wave scattering subsystem that includes a group of patch antennas (i.e., scatterers) that act as radiators. This group of patch antennas comprises an array of scattering metamaterial elements.

In one embodiment, each scattering element in the antenna system is part of a unit cell that consists of a lower conductor, a dielectric substrate and an upper conductor that embeds a complementary electric inductive-capacitive resonator ("complementary electric LC" or "CELC") that is etched in or deposited onto the upper conductor.

In one embodiment, a liquid crystal (LC) is injected in the gap around the scattering element. Liquid crystal is encapsulated in each unit cell and separates the lower conductor associated with a slot from an upper conductor associated with its patch. Liquid crystal has a permittivity that is a function of the orientation of the molecules comprising the liquid crystal, and the orientation of the molecules (and thus the permittivity) can be controlled by adjusting the bias voltage across the liquid crystal. Using this property, the liquid crystal acts as an on/off switch for the transmission of energy from the guided wave to the CELC. When switched on, the CELC emits an electromagnetic wave like an electrically small dipole antenna.

Controlling the thickness of the LC increases the beam switching speed. A fifty percent (50%) reduction in the gap between the lower and the upper conductor (the thickness of the liquid crystal) results in a fourfold increase in speed. In another embodiment, the thickness of the liquid crystal results in a beam switching speed of approximately fourteen milliseconds (14 ms). In one embodiment, the LC is doped in a manner well-known in the art to improve responsiveness so that a seven millisecond (7 ms) requirement can be met.

The CELC element is responsive to a magnetic field that is applied parallel to the plane of the CELC element and perpendicular to the CELC gap complement. When a voltage is applied to the liquid crystal in the metamaterial scattering unit cell, the magnetic field component of the guided wave induces a magnetic excitation of the CELC, which, in turn, produces an electromagnetic wave in the same frequency as the guided wave.

The phase of the electromagnetic wave generated by a single CELC can be selected by the position of the CELC on the vector of the guided wave. Each cell generates a wave in phase with the guided wave parallel to the CELC. Because the CELCs are smaller than the wave length, the output wave has the same phase as the phase of the guided wave as it passes beneath the CELC.

In one embodiment, the cylindrical feed geometry of this antenna system allows the CELC elements to be positioned at forty five degree (45°) angles to the vector of the wave in the wave feed. This position of the elements enables control of the polarization of the free space wave generated from or received by the elements. In one embodiment, the CELCs are arranged with an inter-element spacing that is less than a free-space wavelength of the operating frequency of the antenna. For example, if there are four scattering elements per wavelength, the elements in the 30 GHz transmit antenna will be approximately 2.5 mm (i.e., ¼th the 10 mm free-space wavelength of 30 GHz).

In one embodiment, the CELCs are implemented with patch antennas that include a patch co-located over a slot with liquid crystal between the two. In this respect, the metamaterial antenna acts like a slotted (scattering) wave guide. With a slotted wave guide, the phase of the output wave depends on the location of the slot in relation to the guided wave.

Cell Placement

Figure 17:
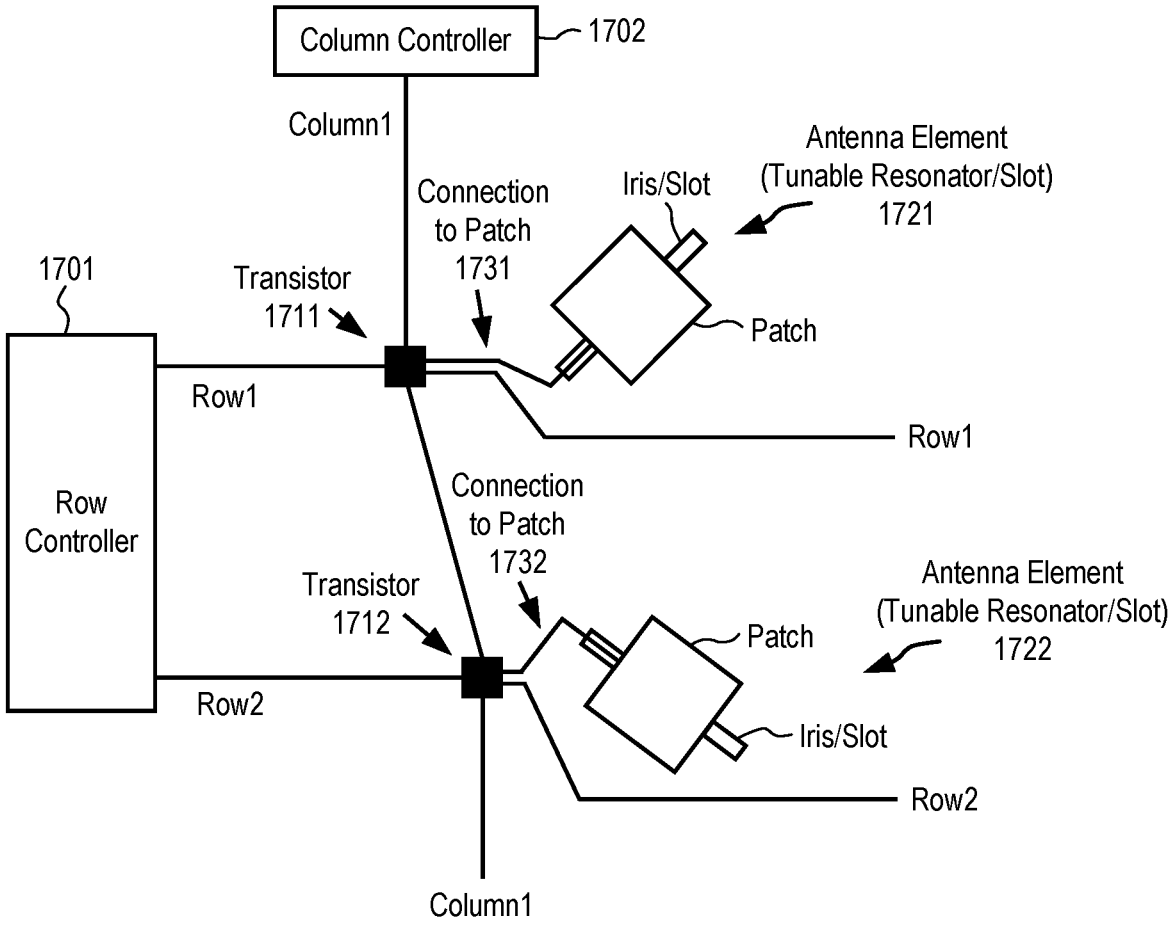
FIG. 17 illustrates one embodiment of the placement of matrix drive circuitry with respect to antenna elements.

In one embodiment, the antenna elements are placed on the cylindrical feed antenna aperture in a way that allows for a systematic matrix drive circuit. The placement of the cells includes placement of the transistors for the matrix drive. FIG. 17 illustrates one embodiment of the placement of matrix drive circuitry with respect to antenna elements. Referring to FIG. 17, row controller 1701 is coupled to transistors 1711 and 1712, via row select signals Row1 and Row2, respectively, and column controller 1702 is coupled to transistors 1711 and 1712 via column select signal Column1. Transistor 1711 is also coupled to antenna element 1721 via connection to patch 1731, while transistor 1712 is coupled to antenna element 1722 via connection to patch 1732.

In an initial approach to realize matrix drive circuitry on the cylindrical feed antenna with unit cells placed in a non-regular grid, two steps are performed. In the first step, the cells are placed on concentric rings and each of the cells is connected to a transistor that is placed beside the cell and acts as a switch to drive each cell separately. In the second step, the matrix drive circuitry is built in order to connect every transistor with a unique address as the matrix drive approach requires. Because the matrix drive circuit is built by row and column traces (similar to LCDs) but the cells are placed on rings, there is no systematic way to assign a unique address to each transistor. This mapping problem results in very complex circuitry to cover all the transistors and leads to a significant increase in the number of physical traces to accomplish the routing. Because of the high density of cells, those traces disturb the RF performance of the antenna due to coupling effect. Also, due to the complexity of traces and high packing density, the routing of the traces cannot be accomplished by commercially available layout tools.

In one embodiment, the matrix drive circuitry is predefined before the cells and transistors are placed. This ensures a minimum number of traces that are necessary to drive all the cells, each with a unique address. This strategy reduces the complexity of the drive circuitry and simplifies the routing, which subsequently improves the RF performance of the antenna.

More specifically, in one approach, in the first step, the cells are placed on a regular rectangular grid composed of rows and columns that describe the unique address of each cell. In the second step, the cells are grouped and transformed to concentric circles while maintaining their address and connection to the rows and columns as defined in the first step. A goal of this transformation is not only to put the cells on rings but also to keep the distance between cells and the distance between rings constant over the entire aperture. In order to accomplish this goal, there are several ways to group the cells.

Figure 18:
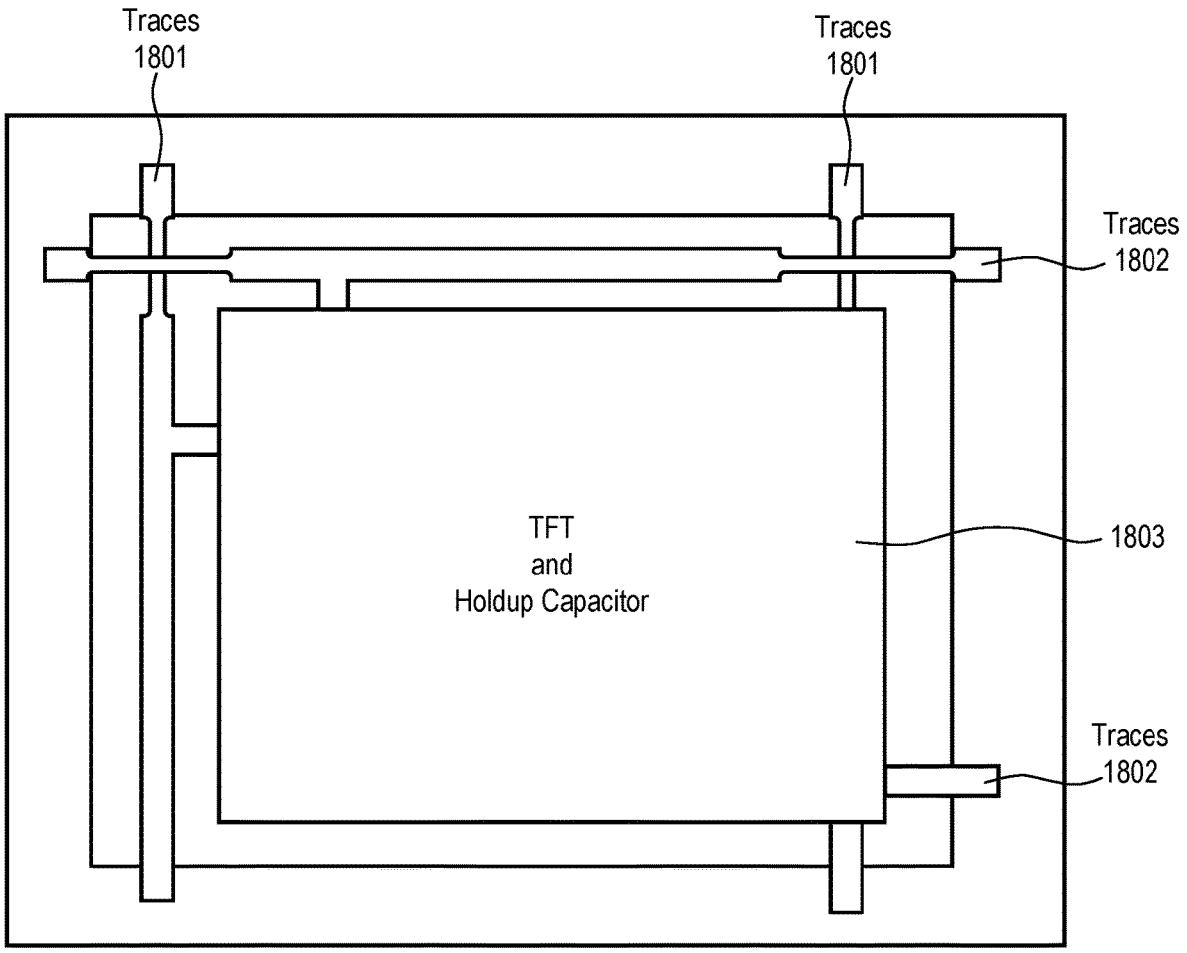
FIG. 18 illustrates one embodiment of a TFT package.

In one embodiment, a TFT package is used to enable placement and unique addressing in the matrix drive. FIG. 18 illustrates one embodiment of a TFT package. Referring to FIG. 18, a TFT and a hold capacitor 1803 is shown with input and output ports. There are two input ports connected to traces 1801 and two output ports connected to traces 1802 to connect the TFTs together using the rows and columns. In one embodiment, the row and column traces cross in 90° angles to reduce, and potentially minimize, the coupling between the row and column traces. In one embodiment, the row and column traces are on different layers.

An Example System Embodiment

In one embodiment, the combined antenna apertures are used in a television system that operates in conjunction with a set top box. For example, in the case of a dual reception antenna, satellite signals received by the antenna are provided to a set top box (e.g., a DirecTV receiver) of a television system. More specifically, the combined antenna operation is able to simultaneously receive RF signals at two different frequencies and/or polarizations. That is, one sub-array of elements is controlled to receive RF signals at one frequency and/or polarization, while another sub-array is controlled to receive signals at another, different frequency and/or polarization. These differences in frequency or polarization represent different channels being received by the television system. Similarly, the two antenna arrays can be controlled for two different beam positions to receive channels from two different locations (e.g., two different satellites) to simultaneously receive multiple channels.

Figure 19:
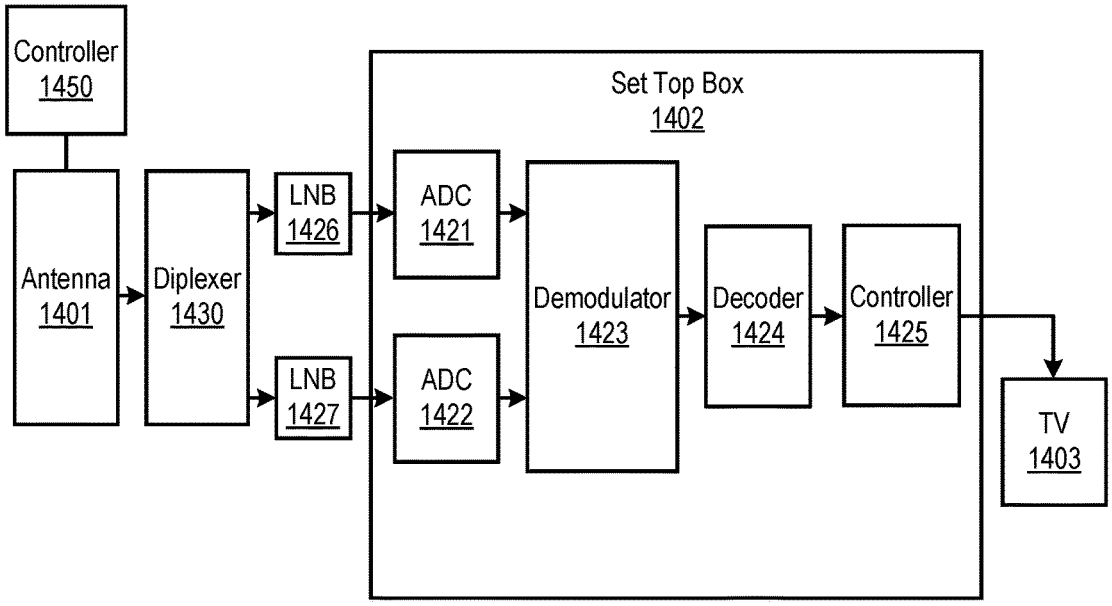
FIG. 19 is a block diagram of one embodiment of a communication system that performs dual reception simultaneously in a television system.

FIG. 19 is a block diagram of one embodiment of a communication system that performs dual reception simultaneously in a television system. Referring to FIG. 19, antenna 1401 includes two spatially interleaved antenna apertures operable independently to perform dual reception simultaneously at different frequencies and/or polarizations as described above. Note that while only two spatially interleaved antenna operations are mentioned, the TV system may have more than two antenna apertures (e.g., 3, 4, 5, etc. antenna apertures).

In one embodiment, antenna 1401, including its two interleaved slotted arrays, is coupled to diplexer 1430. The coupling may include one or more feeding networks that receive the signals from elements of the two slotted arrays to produce two signals that are fed into diplexer 1430. In one embodiment, diplexer 1430 is a commercially available diplexer (e.g., model PB1081WA Ku-band sitcom diplexor from A1 Microwave).

Diplexer 1430 is coupled to a pair of low noise block down converters (LNBs) 1426 and 1427, which perform a noise filtering function, a down conversion function, and amplification in a manner well-known in the art. In one embodiment, LNBs 1426 and 1427 are in an out-door unit (ODU). In another embodiment, LNBs 1426 and 1427 are integrated into the antenna apparatus. LNBs 1426 and 1427 are coupled to a set top box 1402, which is coupled to television 1403.

Set top box 1402 includes a pair of analog-to-digital converters (ADCs) 1421 and 1422, which are coupled to LNBs 1426 and 1427, to convert the two signals output from diplexer 1430 into digital format.

Once converted to digital format, the signals are demodulated by demodulator 1423 and decoded by decoder 1424 to obtain the encoded data on the received waves. The decoded data is then sent to controller 1425, which sends it to television 1403.

Controller 1450 controls antenna 1401, including the interleaved slotted array elements of both antenna apertures on the single combined physical aperture.

An Example of a Full Duplex Communication System

Figure 20:
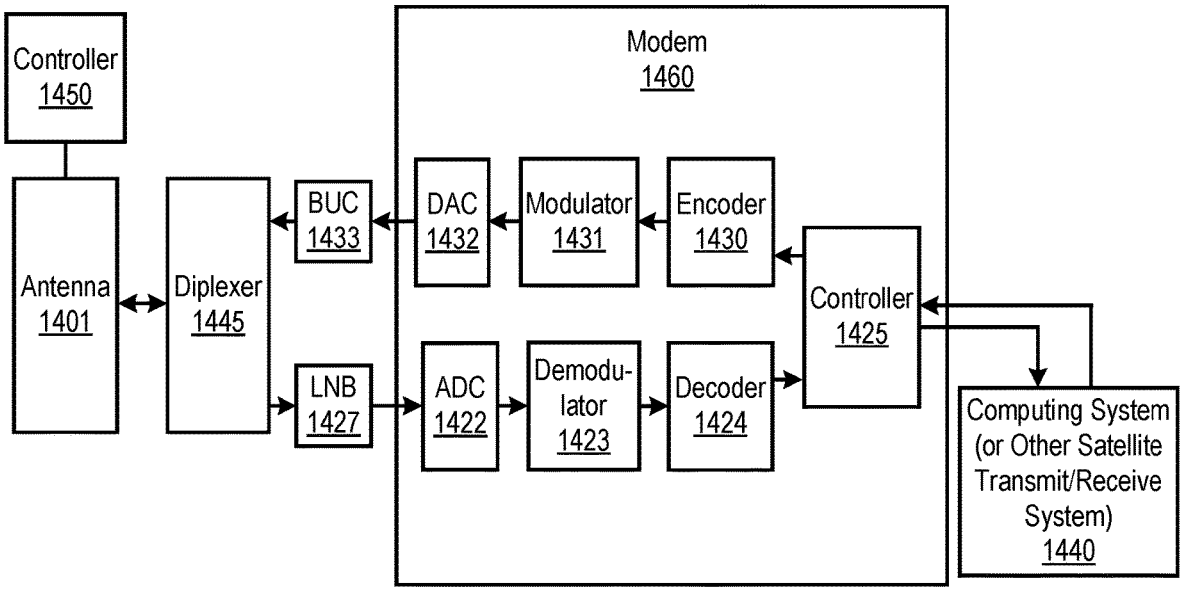
FIG. 20 is a block diagram of another embodiment of a communication system having simultaneous transmit and receive paths.

In another embodiment, the combined antenna apertures are used in a full duplex communication system. FIG. 20 is a block diagram of another embodiment of a communication system having simultaneous transmit and receive paths. While only one transmit path and one receive path are shown, the communication system may include more than one transmit path and/or more than one receive path.

Referring to FIG. 20, antenna 1401 includes two spatially interleaved antenna arrays operable independently to transmit and receive simultaneously at different frequencies as described above. In one embodiment, antenna 1401 is coupled to diplexer 1445. The coupling may be by one or more feeding networks. In one embodiment, in the case of a radial feed antenna, diplexer 1445 combines the two signals and the connection between antenna 1401 and diplexer 1445 is a single broad-band feeding network that can carry both frequencies.

Diplexer 1445 is coupled to a low noise block down converter (LNBs) 1427, which performs a noise filtering function and a down conversion and amplification function in a manner well-known in the art. In one embodiment, LNB 1427 is in an out-door unit (ODU). In another embodiment, LNB 1427 is integrated into the antenna apparatus. LNB 1427 is coupled to a modem 1460, which is coupled to computing system 1440 (e.g., a computer system, modem, etc.).

Modem 1460 includes an analog-to-digital converter (ADC) 1422, which is coupled to LNB 1427, to convert the received signal output from diplexer 1445 into digital format. Once converted to digital format, the signal is demodulated by demodulator 1423 and decoded by decoder 1424 to obtain the encoded data on the received wave. The decoded data is then sent to controller 1425, which sends it to computing system 1440.

Modem 1460 also includes an encoder 1430 that encodes data to be transmitted from computing system 1440. The encoded data is modulated by modulator 1431 and then converted to analog by digital-to-analog converter (DAC) 1432. The analog signal is then filtered by a BUC (up-convert and high pass amplifier) 1433 and provided to one port of diplexer 1445. In one embodiment, BUC 1433 is in an out-door unit (ODU).

Diplexer 1445 operating in a manner well-known in the art provides the transmit signal to antenna 1401 for transmission.

Controller 1450 controls antenna 1401, including the two arrays of antenna elements on the single combined physical aperture.

Note that the full duplex communication system shown in FIG. 20 has a number of applications, including but not limited to, internet communication, vehicle communication (including software updating), etc.

Some portions of the detailed descriptions above are presented in terms of algorithms and symbolic representations of operations on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps leading to a desired result. The steps are those requiring physical manipulations of physical quantities. Usually, though not necessarily, these quantities take the form of electrical or magnetic signals capable of being stored, transferred, combined, compared, and otherwise manipulated. It has proven convenient at times, principally for reasons of common usage, to refer to these signals as bits, values, elements, symbols, characters, terms, numbers, or the like.

It should be borne in mind, however, that all of these and similar terms are to be associated with the appropriate physical quantities and are merely convenient labels applied to these quantities. Unless specifically stated otherwise as apparent from the following discussion, it is appreciated that throughout the description, discussions utilizing terms such as "processing" or "computing" or "calculating" or "determining" or "displaying" or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

The present invention also relates to apparatus for performing the operations herein. This apparatus may be specially constructed for the required purposes, or it may comprise a general purpose computer selectively activated or reconfigured by a computer program stored in the computer. Such a computer program may be stored in a computer readable storage medium, such as, but is not limited to, any type of disk including floppy disks, optical disks, CD-ROMs, and magnetic-optical disks, read-only memories (ROMs), random access memories (RAMs), EPROMs, EEPROMs, magnetic or optical cards, or any type of media suitable for storing electronic instructions, and each coupled to a computer system bus.

The algorithms and displays presented herein are not inherently related to any particular computer or other apparatus. Various general purpose systems may be used with programs in accordance with the teachings herein, or it may prove convenient to construct more specialized apparatus to perform the required method steps. The required structure for a variety of these systems will appear from the description below. In addition, the present invention is not described with reference to any particular programming language. It will be appreciated that a variety of programming languages may be used to implement the teachings of the invention as described herein.

A machine-readable medium includes any mechanism for storing or transmitting information in a form readable by a machine (e.g., a computer). For example, a machine-readable medium includes read only memory ("ROM"); random access memory ("RAM"); magnetic disk storage media; optical storage media; flash memory devices; etc.

Whereas many alterations and modifications of the present invention will no doubt become apparent to a person of ordinary skill in the art after having read the foregoing description, it is to be understood that any particular embodiment shown and described by way of illustration is in no way intended to be considered limiting. Therefore, references to details of various embodiments are not intended to limit the scope of the claims which in themselves recite only those features regarded as essential to the invention.

We claim:

1. An antenna comprising:

a radial waveguide having a structure through which an RF feed wave propagates, wherein the structure has an outer portion surrounding an area of the waveguide;

an aperture operable to radiate radio frequency (RF) signals in response to the RF feed wave fed from the outer portion of the radial waveguide without a fixed physical connection to the waveguide, a first surface of the outer portion of the radial waveguide facing and overlapping a second surface at a bottom and outer portion of the aperture to form a gap between the first and second surfaces, the first and second surfaces to move laterally with respect to each other in response to heat due to differences in coefficients of thermal expansion of the waveguide and the aperture; and a radio frequency (RF) choke operable to block RF energy from exiting through the gap between outer portions of the waveguide and the aperture.

2. The antenna defined in claim 1 wherein no electrically conductive connection exists between the waveguide and the aperture.

3. The antenna defined in claim 1 wherein the second surface is part of a slip plane attached to a bottom of the aperture.

4. The antenna defined in claim 1 wherein the waveguide comprises metal and the aperture comprises a glass or liquid crystal display (LCD) substrate.

5. The antenna defined in claim 1 wherein the RF choke comprises one or more slots in the outer portion of the waveguide in the gap with each of the one or more slots being used to block RF energy of a frequency band.

6. The antenna defined in claim 5 wherein the one or more slots are part of a pair of rings in the outer portion of the waveguide.

7. The antenna defined in claim 1 wherein the RF choke comprises an electromagnetic band gap (EBG) structure.

8. The antenna defined in claim 7 wherein the EBG structure comprises a substrate with one or more vias.

9. The antenna defined in claim 8 wherein the substrate comprises a printed circuit board (PCB) with one or more electrically conductive pads and the one or more vias are plated with electrically conductive material.

10. The antenna defined in claim 9 wherein the PCB is attached with conductive adhesive to the waveguide.

11. The antenna defined in claim 1 wherein the aperture has a slotted array of antenna elements, wherein the slotted array comprises:

a plurality of slots;

a plurality of patches, wherein each of the patches is co-located over and separated from a slot in the plurality of slots, forming a patch/slot pair, each patch/slot pair being turned off or on based on a magnitude of a voltage applied to the patch in the pair.

12. The antenna defined in claim 11 wherein the antenna elements are controlled and operable together to form a beam for a frequency band for use in holographic beam steering.

13. An antenna comprising:

a radial waveguide having a structure through which an RF feed wave propagates, wherein the structure has an outer portion surrounding an area of the waveguide;

an aperture operable having a plurality of antenna elements to radiate radio frequency (RF) signals in response to the RF feed wave fed from the outer portion of the radial waveguide without a fixed physical connection to the waveguide, a first surface of the outer portion of the radial waveguide facing and overlapping a second surface at a bottom and outer portion of the aperture to form a gap between the first and second surfaces, the first and second surfaces to move laterally with respect to each other in response to heat due to differences in coefficients of thermal expansion of the waveguide and the aperture; and an antenna feed coupled to the waveguide to feed the RF feed wave into the waveguide;

a layer between the waveguide and the aperture around which the feed wave travels to feed the plurality of antenna elements from outer edges of the layer; and a radio frequency (RF) choke operable to block RF energy from exiting through the gap between outer portions of the waveguide and the aperture.

14. The antenna defined in claim 13 wherein the layer comprises at least one of a group consisting of a ground layer and a dielectric layer.

15. The antenna defined in claim 13 wherein no electrically conductive connection exists between the waveguide and the aperture.

16. The antenna defined in claim 13 wherein the second surface is part of a slip plane attached to a bottom of the aperture.

17. The antenna defined in claim 13 wherein the waveguide comprises metal and the aperture comprises a glass or liquid crystal display (LCD) substrate.

18. The antenna defined in claim 13 wherein the RF choke comprises one or more slots in the outer portion of the waveguide in the gap with each of the one or more slots being used to block RF energy of a frequency band.

19. The antenna defined in claim 18 wherein the one or more slots are part of a pair of rings in the outer portion of the waveguide.

20. The antenna defined in claim 13 wherein the RF choke comprises an electromagnetic band gap (EBG) structure.

21. The antenna defined in claim 20 wherein the EBG structure comprises a substrate with one or more vias.

22. The antenna defined in claim 21 wherein the substrate comprises a printed circuit board (PCB) with one or more electrically conductive pads and the one or more vias are plated with electrically conductive material.

23. The antenna defined in claim 22 wherein the PCB is attached with conductive adhesive to the waveguide.

24. The antenna defined in claim 13 wherein the aperture has a slotted array of antenna elements, wherein the slotted array comprises:

a plurality of slots;

a plurality of patches, wherein each of the patches is co-located over and separated from a slot in the plurality of slots, forming a patch/slot pair, each patch/slot pair being turned off or on based on a magnitude of a voltage applied to the patch in the pair.

25. The antenna defined in claim 24 wherein liquid crystal is between each slot of the plurality of slots and its associated patch in the plurality of patches.

26. The antenna defined in claim 25 further comprising a controller that applies a control pattern that controls which patch/slot pairs are on and off, thereby causing generation of a beam.

27. The antenna defined in claim 13 wherein the antenna elements are controlled and operable together to form a beam for a frequency band for use in holographic beam steering.

28. An antenna comprising:

a radial waveguide having a structure through which an RF feed wave propagates, wherein the structure has an outer portion surrounding an area of the waveguide;

an aperture operable to radiate radio frequency (RF) signals in response to the RF feed wave fed from the outer portion of the radial waveguide without a fixed physical connection to the waveguide, a first surface of the outer portion of the radial waveguide facing and overlapping a second surface at a bottom and outer portion of the aperture to form a gap between the first and second surfaces, the first and second surfaces to move laterally with respect to each other in response to heat due to differences in coefficients of thermal expansion of the waveguide and the aperture, wherein the aperture has a slotted array of antenna elements, wherein the slotted array comprises:

a plurality of slots;

a plurality of patches, wherein each of the patches is co-located over and separated from a slot in the plurality of slots, forming a patch/slot pair, each patch/slot pair being turned off or on based on a magnitude of a voltage applied to the patch in the pair;

a radio frequency (RF) choke operable to block RF energy from exiting through the gap between outer portions of the waveguide and the aperture; and wherein no electrically conductive connection exists between the waveguide and the aperture.

* * * * *